US011529745B2

(12) United States Patent
Zafiropoulos

(10) Patent No.: US 11,529,745 B2
(45) Date of Patent: Dec. 20, 2022

(54) SMART SHAVING ACCESSORY

(71) Applicant: Bic Violex S.A., Anoixi (GR)

(72) Inventor: Pete Zafiropoulos, Wallingford, CT (US)

(73) Assignee: Bic Violex Single Member S.A., Anoixi (GR)

( * ) Notice: Subject to any disclaimer, the term of this patent is extended or adjusted under 35 U.S.C. 154(b) by 0 days.

(21) Appl. No.: 16/972,704

(22) PCT Filed: Jun. 6, 2019

(86) PCT No.: PCT/EP2019/064770
§ 371 (c)(1),
(2) Date: Dec. 7, 2020

(87) PCT Pub. No.: WO2019/234144
PCT Pub. Date: Dec. 12, 2019

(65) Prior Publication Data

US 2021/0260780 A1 Aug. 26, 2021

Related U.S. Application Data

(60) Provisional application No. 62/682,292, filed on Jun. 8, 2018.

(51) Int. Cl.
*B26B 19/38* (2006.01)
*B26B 21/40* (2006.01)

(52) U.S. Cl.
CPC ..... *B26B 19/3813* (2013.01); *B26B 19/388* (2013.01); *B26B 21/4056* (2013.01); *B26B 21/4081* (2013.01)

(58) Field of Classification Search
CPC ..... B26B 19/3813; B26B 19/388; B26B 21/4056; B26B 21/4081
(Continued)

(56) References Cited

U.S. PATENT DOCUMENTS 9,174,351 B2 11/2015 Binder
11,007,659 B2 * 5/2021 Goldfarb ..... B26B 21/225
(Continued)

FOREIGN PATENT DOCUMENTS

CN 102470532 A 5/2012
CN 105741256 A 7/2016
(Continued)

OTHER PUBLICATIONS

International Search Report and Written Opinion in corresponding Application No. PCT/EP2019/064770, dated Oct. 16, 2019 (13 pages).
(Continued)

*Primary Examiner* — Omar Flores Sanchez
(74) *Attorney, Agent, or Firm* — Bookoff McAndrews, PLLC

(57) ABSTRACT

The present disclosure provides a razor accessory with a camera to assist the user of a shaving razor, which razor accessory is configured to be mechanically attached to the shaving razor. The razor accessory may be provided with sensors to track the shaving movements of a user. The present disclosure also provides an application for a wearable computer device to track the shaving movements of a user. The razor accessory and/or the wearable computer is communicatively connected to a vendor platform via an Internet-of-Things (IoT) gateway, which may provide feedback to assist and optimize the user's shaving experience.

20 Claims, 17 Drawing Sheets

(58) Field of Classification Search
USPC ..... 30/34.1
See application file for complete search history.

(56) References Cited

U.S. PATENT DOCUMENTS

| | | | | |
|---|---|---|---|---|
| 2013/0021460 | A1* | 1/2013 | Burdoucci | A45D 44/005 348/77 |
| 2013/0250084 | A1 | 9/2013 | Binder | |
| 2016/0167241 | A1* | 6/2016 | Goldfarb | B26B 21/28 382/108 |
| 2017/0053542 | A1 | 2/2017 | Wilson et al. | |
| 2018/0354147 | A1* | 12/2018 | Goldfarb | B26B 21/56 |
| 2020/0033448 | A1* | 1/2020 | Bourquin | G01S 7/4815 |
| 2020/0201266 | A1* | 6/2020 | Joyce | G16H 40/63 |

FOREIGN PATENT DOCUMENTS

| | | | |
|---|---|---|---|
| CN | 107718059 | A | 2/2018 |
| EP | 1154377 | A1 | 11/2001 |
| WO | 9926411 | A1 | 5/1999 |
| WO | 2009076301 | A2 | 6/2009 |
| WO | 2015067634 | A1 | 5/2015 |
| WO | 2016094327 | A1 | 6/2016 |
| WO | 2017012969 | A1 | 1/2017 |

OTHER PUBLICATIONS

Chinese Office Action in corresponding Chinese Application No. 201980030559.X, dated May 17, 2022 (13 pages).

* cited by examiner

600

SMART SHAVING ACCESSORY

CROSS REFERENCE TO RELATED APPLICATIONS

This application is a National Stage Application of International Application No. PCT/EP2019/064770, filed on Jun. 6, 2019, now published as WO 2019/234144, and which claims priority to U.S. Provisional Patent Application Ser. No. 62/682,292, filed Jun. 8, 2018, entitled "SMART SHAVING ACCESSORY".

BACKGROUND OF THE DISCLOSURE

1. Field of the Disclosure

The present disclosure relates to a smart shaving system.

2. Description of the Related Art

To achieve optimal shaving results, it is helpful to tailor the choice of a shaving razor to the unique physical characteristics of a user, e.g., skin contour, skin type, moles, scars, in-grown hair, growths, hair type, and hair thickness. In addition, it is often difficult for a user to determine (e.g., by visual inspection or using a camera) the user's unique physical characteristics such as the ones noted above, as well as to determine whether a particular skin surface area has been adequately shaved. Therefore, there is a need for a system that can, inter alia, (i) assist in determining the unique physical characteristics of a user, which determination will in turn assist in tailoring the choice of a shaving razor to the unique physical characteristics of the user, (ii) assist in determining whether a particular skin surface area has been adequately shaved, (iii) assist in understanding and optimizing a user's shaving habits.

SUMMARY

The present disclosure provides a smart shaving system razor accessory with a camera or imaging device to assist a user of a shaving razor. In an embodiment, the razor accessory may comprise a light source.

The present disclosure also provides a smart shaving system razor accessory with a camera to assist the user of a shaving razor, in which the razor accessory is an attachable shaving accessory configured to be attached to a shaver.

The present disclosure provides an application for a wearable computer configured for a smart shaving system to assist the user of a shaving razor.

The present disclosure also provides a smart shaving system razor accessory with a camera to assist the user of a shaving razor, in which camera assists the user of the razor to determine whether a particular skin surface area has been adequately shaved.

The present disclosure provides an application for a wearable computer configured for a smart shaving system to assist the user of a shaving razor, which assists the user of the razor to determine whether a particular skin surface area has been adequately shaved.

The present disclosure provides an application for a wearable computer configured for a smart shaving system, in which the wearable computer includes has hardware/software configured as a stand-alone Internet-of-Things (IoT) device.

The present disclosure provides a smart shaving system razor accessory with a camera, in which the attachment is communicatively connected to a vendor platform via an Internet-of-Things (IoT) gateway.

The present disclosure provides application for a wearable computer configured for a smart shaving system, in which the attachment is communicatively connected to a vendor platform via an Internet-of-Things (IoT) gateway.

The present disclosure also provides a smart shaving system razor accessory with a camera, in which the attachment is communicatively connected to the shaving razor and/or to a vendor platform via an Internet-of-Things (IoT) gateway to (i) assist the user to determine whether a particular skin surface area has been adequately shaved, and/or (ii) assist the user regarding the type of shaving cartridge and/or razor suited for the particular user's physical characteristics (e.g., skin and/or hair).

The present disclosure provides application for a wearable computer device configured for a smart shaving system, in which the wearable computer device is communicatively connected to a vendor platform via an Internet-of-Things (IoT) gateway to assist the user in determining (i) a shaving cartridge suited for the at least one movement characteristic, (ii) a shaving razor suited for the at least one movement characteristic, and (iii) an optimal shaving notification.

The present disclosure also provides a smart shaving system with wearable computer device and/or and a razor accessory a camera, in which the razor accessory, the wearable computer device, an application on a user device, a vendor platform and/or other linked devices may access and/or cumulatively collect, store, and/or analyze a particular user's physical characteristics (e.g., hair and skin type), historical shaving cartridge information, and/or shaving habits to assist the particular user regarding the type of shaving cartridge and/or razor suited for the particular user's physical characteristics (e.g., skin and/or hair), historical shaving cartridge information and shaving habits.

BRIEF DESCRIPTION OF THE DRAWINGS

A component or a feature that is common to more than one drawing is indicated with the same reference number in each of the drawings.

DETAILED DESCRIPTION OF THE DISCLOSURE

Figure 1:
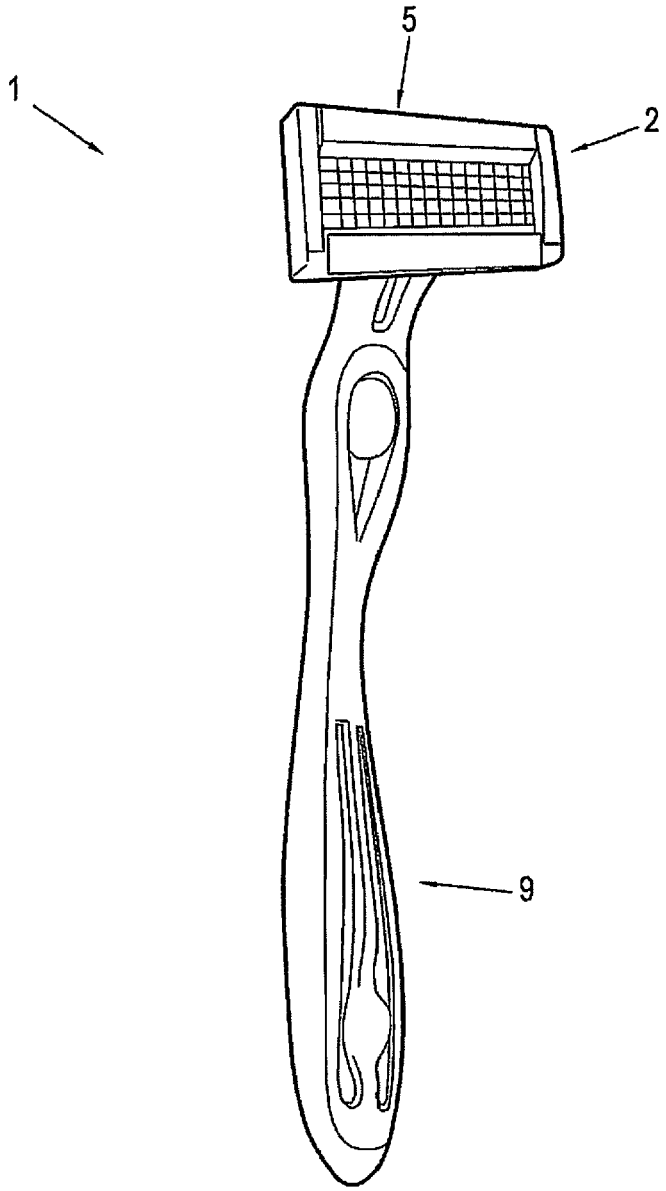
FIG. 1 is a perspective view of an example of a razor having a handle.

Referring to the drawings and, in particular to FIG. 1, an example razor 1 having a handle 9 and a cartridge 5 including a plurality of blades is shown. In this exemplary embodiment, a "smart" polymer 5 designed to selectively generate lubricant, cosmetic and/or other materials may be provided on the cartridge. "Smart" polymers are artificial materials designed to respond in a particular manner when exposed to at least one environmental stimulus. The environmental stimulus may include temperature, pH, humidity/moisture, redox, weight, electrical stimulus, chemical stimulus, light (wavelength and/or intensity), electric/magnetic field, and/or electrochemical stimulus.

Figure 2:
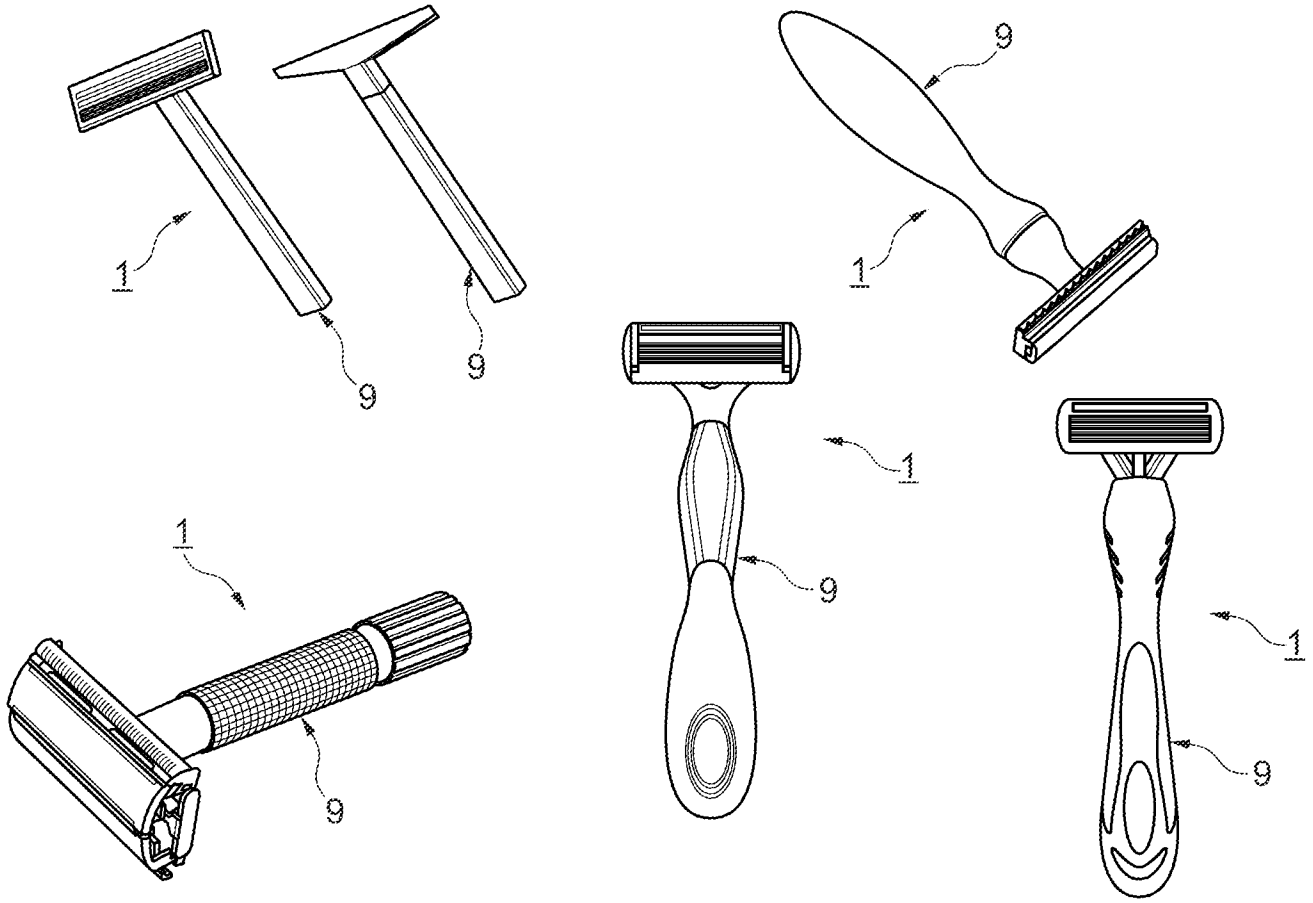
FIG. 2 shows examples of a plurality of different shaped razors.

As will be appreciated, as shown in FIG. 2, razors 1 and razor handles 9 may take many shapes, a few of which are shown. Shavers and razors include disposable shavers, which are easy to use and low cost. Disposable shavers are lower in cost, but should still offer a performance that matches that cost. In other cases, a user may have a particular razor they use and do not wish to replace, for example, a shaver with a high end or specifically crafted razor handle 9.

Described herein are embodiments of a razor attachment that may be attached to and detached from any shaver and may work with a smart shaver system that includes, inter alia, a smart phone application or other user device application to analyze data collected and provide feedback to the user. Also described herein are embodiments of a wearable computer device that may include an application to analyze data collected and provide feedback to the user and/or pair with smart phone application or other user device application to do the same.

Figure 3A:
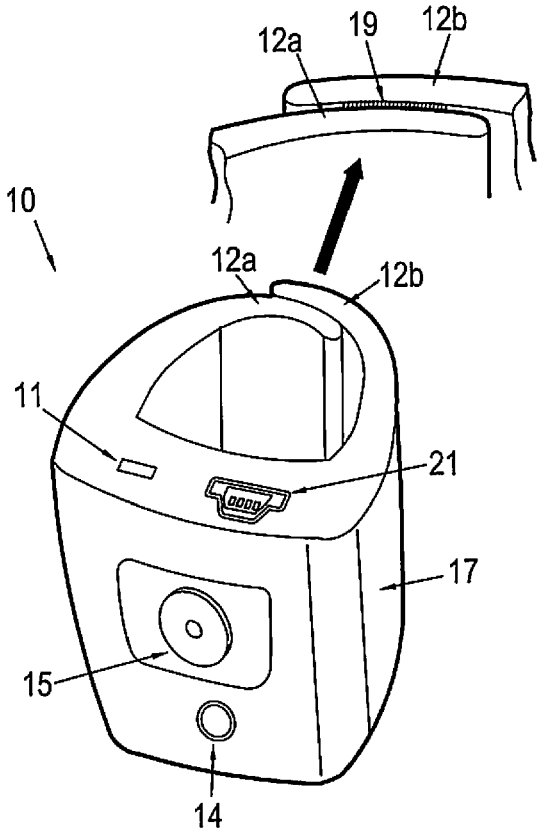
FIG. 3A shows a perspective view of an exemplary embodiment of a razor accessory.
Figure 3B:
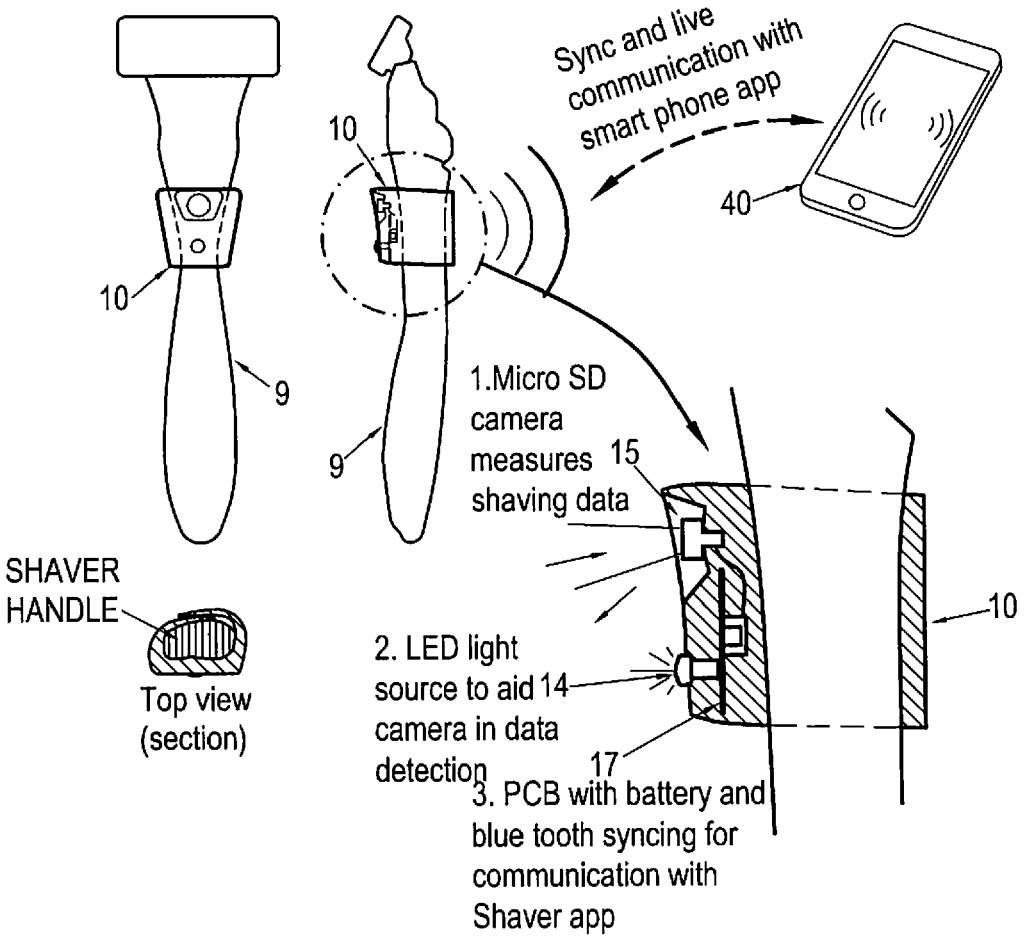
FIG. 3B shows front and side views of an exemplary razor accessory and a razor.
Figure 3C:
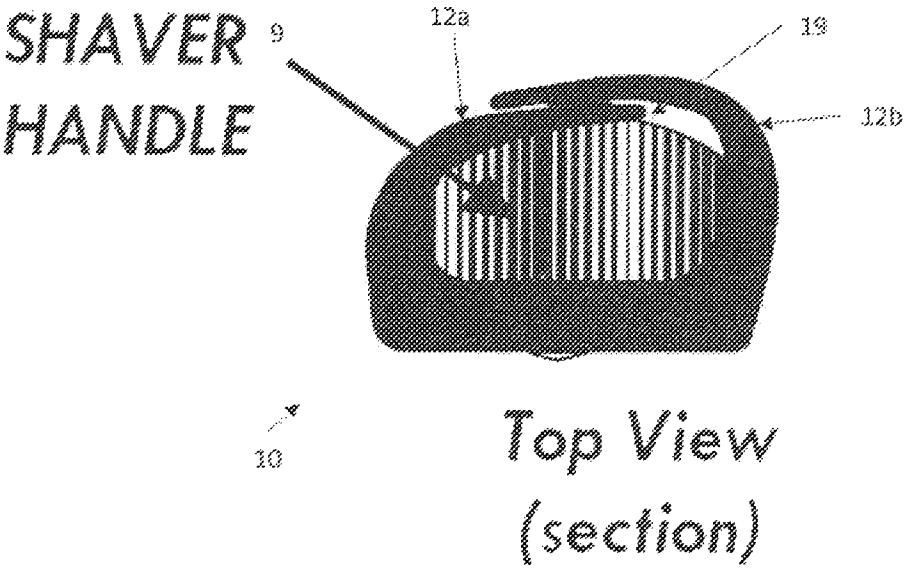
FIG. 3C shows a plan view of an exemplary embodiment of a razor accessory and shaver handle.
Figure 4:
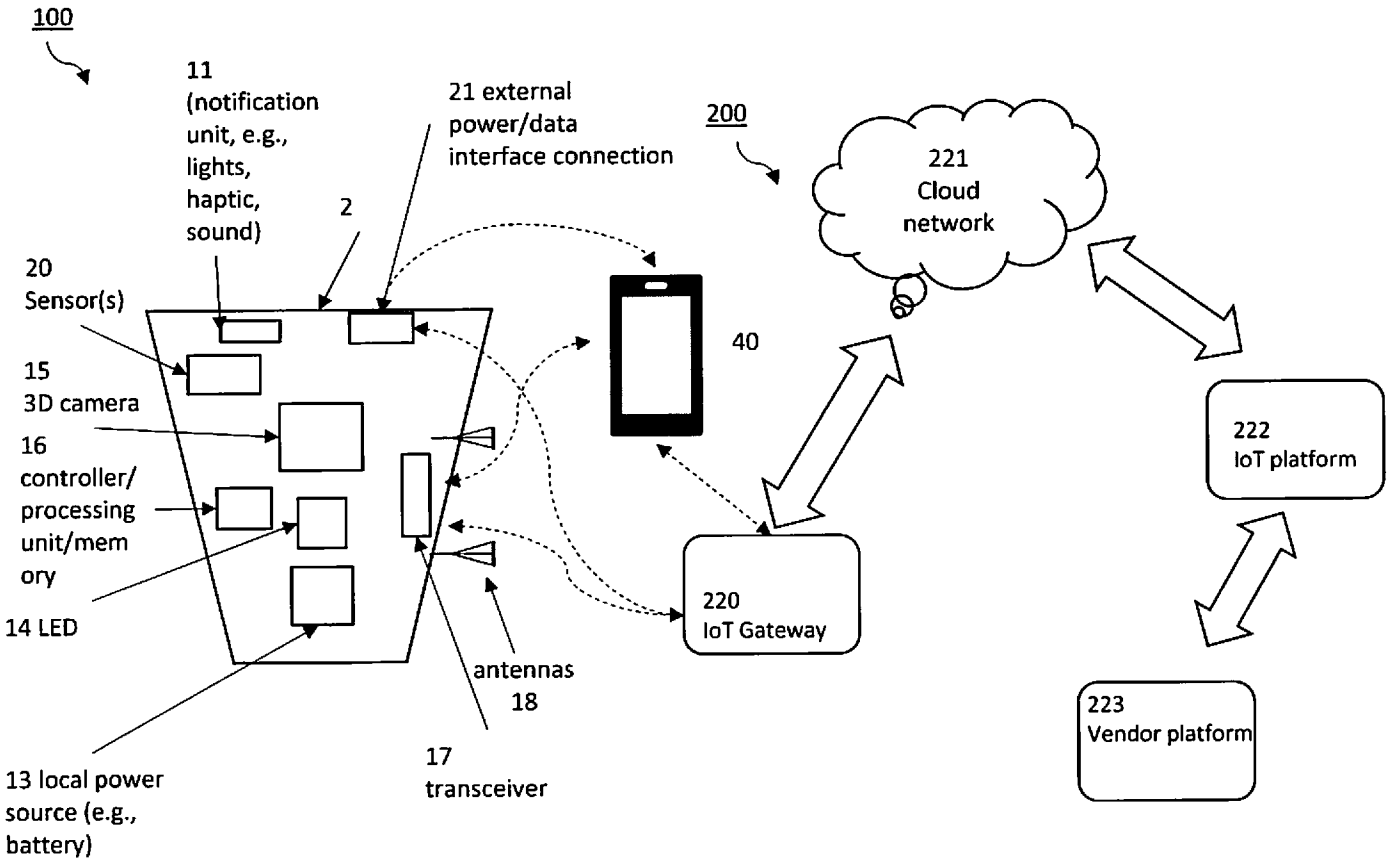
FIG. 4 is a schematic showing various electric/electronic components of a razor accessory and external communication infrastructure according to an embodiment of the present disclosure.

As shown in FIGS. 3A-4, described herein are embodiments of a razor accessory 10 for a smart shaving system. The razor accessory 10 is configured to be attached to any razor. FIGS. 3A-3C shows an example of a razor accessory 10. The razor accessory 10 includes an imaging device such as a camera 15 configured to measure stroke, speed, skin condition and hair direction. The imaging device may include a camera 15 selected from one or more cameras or camera types, for example, an HD camera, 2D camera, a 3D camera, and so on. As will be appreciated, in one or more embodiments, the razor accessory may be outfitted with any camera or other imaging device employed in, inter alia, mobile user devices (e.g. smartphone/tablet cameras) as known in the art.

The razor accessory 10 may also include a light source 14, for example, one or more LED lights. The light source 14 is positioned to illuminate a surface the camera 15 is imaging. In an embodiment, the light source 14 may be configured to turn on when the accessory is in use. For example, in an embodiment, the light source 14 may be configured to turn on in a low-light environment when the razor is in use.

In an embodiment, the light source 14 may be configured to emit different colors. For example, a plurality LEDs may be configured to emit different color lighting. As LEDs typically emit one color, the light source 14 on the accessory may be comprised of multiple LEDs to select a particular color from a plurality of colors. In an embodiment, the selection may be made in the application 111 of a user device 40, for example. The color selection may serve as an option to best meet a user's needs in being able to better see the area being shaved. For example, certain skin pigments reflect and contrast white light best while others work best with variations of blue or green.

In an embodiment, the razor accessory may be configured to provide feedback using the light source 14 while shaving. For example, where the light source 14 is configured to illuminate in different colors, the razor accessory 10 may be configured to have the light source 14 produce different colored lights for positive and negative feedback. For example, a steady green light may be employed for positive feedback: e.g: a user is shaving at an optimal speed, or a target area being shaved is free of hair. The razor accessory may also be configured to have the light source produce a red or blinking red light for negative feedback, for example: shaving strokes are too fast and need to be slower, not all the hair has been shaved in the target area, or that an applied shaving angle is incorrect. Light color may also be employed to signal different functions of the razor accessory 10, for example, a green light signaling that the razor accessory 10 is measuring speed or a blue light signaling the razor accessory 10 is measuring pressure so that a user knows what type of information is being collected by the razor accessory 10. As will be appreciated, the light source 40 may be configured to provide feedback using techniques other than or in addition to color, for example, blinking and flashing, intensity, light patterns, and so on.

The razor accessory 10 may be attached to and detached from a shaver handle 9. As shown in FIGS. 3A-4, the razor accessory 10 is configured to be attached at the handle position 9. In an embodiment, the razor accessory 10 includes two flexible flaps 12*a*,12*b*, which are configured to wrap around the handle 9 and attach mechanically as the flaps 12*a*,12*b* wrap around the handle 9. The razor accessory 10 flaps 12*a*,12*b* include a mechanical fastener for attaching behind the handle 9. Exemplary fasteners may include, for example, magnets, hook and loop fasteners, snaps, or other fasteners. In an alternative embodiment, the flaps 12*a*,12*b* may comprise a deformable elastomeric or metal material that holds its shape when bent into position. In an embodiment, the razor accessory comprises a high friction thermoplastic elastomer (TPE), where the friction coefficient also holds the razor accessory 10 in position on the razor handle 2 when fastened thereon.

The razor accessory 10 is configured to be synced to a smart phone, personal computer device or other user device 40 as described herein, for example via a Bluetooth™ transceiver 17. In an embodiment, an indicator 11 may be configured for signal pairing. As also described herein, the razor accessory 10 may include an input/output port 16, for example a USB port, where the razor accessory 10 may be connected for recharge and update. Once the razor accessory 10 is paired, the shaver application may be provided to the user device 40. In an embodiment, the application is configured to receive the shaving data, and the application software is configured with artificial intelligence (AI) software or operatively connected to another smart shaving system device AI that may analyze the shaving data to provide real time feedback as described herein.

FIG. 4 illustrates various examples of (i) electric and/or electronic components of a razor accessory 10 (shown on the left side of FIG. 4) having electronic components of an external communication infrastructure 200 (shown on the right side of FIG. 4), and various connection and communication paths between the razor accessory 10 and the external communication infrastructure 200, according to an embodiment of the present disclosure.

Razor accessory 10, illustrated in FIG. 4, includes the following exemplary components that are electrically and/or communicatively connected: a camera 15; a notification unit 11, which may be configured to generate a visual (e.g., lights), haptic and/or sound notification; a control unit 16, which may be configured to include a controller, a processing unit and/or a memory; a local power source 13 (e.g., battery); an interface unit 21, which may be configured as an interface for external power connection and/or external data connection; a transceiver unit 17 for wireless communication; and antennas 18. Some of the communication technologies that may be used in connection with units 11 and 16 include cellular, satellite, WiFi, Bluetooth, low-power wide-area networks (LPWAN) or connecting directly to the internet via ethernet. Some of the data transfer protocols that may be utilized include, e.g., hypertext transfer protocol (HTTP), message queuing telemetry transport (MQTT), and constrained application protocol (CoAP), which examples are not limiting.

In an embodiment, the razor accessory may also include one or more activity sensors 20 for detecting an activity of a user of the accessory on the razor. Activity sensors 20 may include one or more of a type of sensor to detect motion, including, an accelerometer, a gyroscope, a motion sensor, or other sensor(s), and/or a combination thereof, all of which may be operatively connected to transceiver 17 and controller 16. While not shown, other sensor(s), may include any of a passive infrared sensor, an ultrasonic sensor, a microwave sensor, a tomographic motion detector, a light sensor, a timer, or the like.

For example, accelerometer, directional sensor, and gyroscope may further generate activity data that may be used to determine whether a user of razor 1 and razor accessory 10 is engaging in an activity, i.e. shaving, is inactive, or is performing a particular gesture. For example, the sensor data may be used to allow the shaving system to determine a shaving stroke, a non-shaving backstroke, stroke pressure, stroke speed, blade rinsing time, number of strokes, number of strokes per shaving zone, etc.

In some embodiments, the sensor 20 movement or operation of the camera 15 may be used to indicate to control unit 16 that razor accessory is being used. Thus, the camera 15 or the sensors 20 may be used as a switch to "wake-up" other electronic systems of razor accessory 10. The use of sensors 20 or the camera as a switch may help conserve energy by ensuring that the electronic systems of razor accessory are used only when needed, e.g., during a shaving session.

The razor accessory 10 may include a timer (not shown) that may be used, for example, to add time dimensions to various attributes of the detected physical activity, such as a duration of a user's physical activity (e.g. shaving time, blade washing/rinsing time) or inactivity, time(s) of a day when the activity is detected or not detected, etc.

The one or more activity sensors 20 may be embedded in the body of the razor accessory 10, on the outside of the accessory (e.g. near or a top or bottom surface of the body of device) or may be positioned at any other desirable location. In some examples, different activity sensors 20 may be placed in different locations inside or on the surfaces of the razor accessory 20—e.g., some located inside the body and some on the bands 12*a*,12*b* an upper or bottom surface, or the like.

Control unit 16 may also (i) receive and process the information output from the camera 15, and/or (ii) control the camera 15 to capture and/or output visual information. In an example embodiment, the camera 15 may capture images (e.g., of the user's skin surface) when the recording function of the camera 15 is activated. In this case, as shown in FIG. 4, the information captured by the camera 15 may be processed by the control unit 16 and/or presented for viewing, e.g., via a display element of a user device 40, for example mobile device 40.

Control unit 16 may cumulatively collect and/or store the information regarding the shaving actively to analyze and/or determine the individual's shaving habits, use and efficacy. In addition, control unit 16 may analyze the shaving activity in conjunction with (i) information captured by the camera 15 regarding a user's particular skin type and/or hair properties, and/or (ii) data provided by a user or data from a database regarding particular skin type and/or hair properties, thereby enabling customized analysis and data collection of an individual user's physical properties and/or razor use. The data for the user may be combined with a database of shaving data to enable further customized analysis, for example, in combination with data collected and processed by a smart shaving system. The data for the user may be collected and combined with shaving profile data for the user to enable further customized analysis, for example, in combination with date from a smart shaving system, for example as described in U.S. Prov. Pat. App. No. 62/674,099, filed on May 21, 2018 and entitled A SMART SHAVING SYSTEM WITH A 3D CAMERA, and U.S. Prov. Pat. App. No. 62/674,105, filed on May 21, 2018 and entitled SYSTEM AND METHOD FOR PROVIDING A VOICE-ACTIVATED ORDERING OF REPLACEMENT SHAVING CARTRIDGE the entirety of each of which is incorporated by reference hereby. The data regarding shaving activity, particular skin type and/or hair properties, and/or information captured by the camera 15 may be stored (in part or in entirety) in the razor, in a cloud database, or in an external device (e.g., an IoT connected device).

In embodiments, data detected by razor accessory 10 may be analyzed in conjunction with the images of the user taken before and/or during a shaving session, for example using camera 15. The data may be analyzed in conjunction with images and/or mapping of the region of the user's body to be shaved, e.g., the face. For example, before shaving takes place, a user may download an application on his or her smartphone or computer user device 40. When the user begins shaving, the razor accessory or the application on the user device 40 may prompt the user to active the camera to start photographing or taking a video while shaving. As the user shaves, the camera 15 takes photos or video as the camera is moved at different angles relative to the body region, or as the user moves the body region relative to the camera For another example, in an embodiment, as discussed herein, razor accessory 10 may include or may be otherwise coupled to one or more processors 16. Data captured by sensors 20 and camera 15 may be stored in a memory and analyzed by processor(s) 16. In some embodiments, data from camera 15 or sensors 20 on razor accessory 10 may be transmitted to a separate user device, smartphone 40 or computer. In exemplary embodiments, data from camera 15 or sensors 20 may be transmitted to user device 40 equipped with software configured to analyze the received data to provide information to the user pertaining to the user's shaving technique, a number of shaving strokes taken by the user (or distance razor 1 has travelled or speed of razor 1 during a shave stroke), and/or whether the user would benefit from one or more specialized items to optimize shaving performance and comfort. The processor and/or memory may be located on any component of the shaving system, for example, in razor accessory 10 itself, a user device 40 such as a smartphone, or a computer, and the components of the shaving system may transmit any stored or detected data to the processor 16 and/or to an external network 200 for analysis as described herein.

As set forth above, the system may be configured to determine a usage of razor 1 based on the input received from razor accessory 10 camera 15 or sensors 20 over time. For example, processor 16 may be configured to track an overall distance travelled by razor accessory 10 and/or a number of shaving strokes that razor accessory 10 has been used for. For example, when processor 16 determines that razor accessory 10 has exceeded a usage threshold-based distance measurements, or based on a calculated number of shaving strokes taken, processor 16 may generate an alert as described herein.

Differences in the tracking data received from each of sensors 20 or camera 15 may be used by the processor 16 to analyze shaving strokes taken by the user. For example, over the course of a shaving stroke, the varying movements measured by the camera 15 or sensors 20 disposed in the razor accessory 10 may be used by the processor 16 determine that the user is applying too much force to one or more of leading edge, a trailing edge, or either side of the razor 1 while shaving. The uneven application of force may result in cuts, skin irritation, and/or excessive shaving strokes. Similarly, camera 15 or sensors 20 may detect that the user's shaving stroke includes a component of side-to-side movement (e.g., movement in a direction parallel to one or more blades of the razor 1). Such side-to-side movements, or shave strokes including components of side-to-side movement, may result in nicks and/or cuts of the user's skin. In such instances, therefore, processor 16 may be configured to provide a notification or other feedback to the user via the razor accessory 10 or the user device 40 to adjust the shave stroke or otherwise change a direction of movement of the razor 1. Thus, the razor accessory 10 may alert the user of such abnormalities via the various feedback mechanisms described herein. For example, if processor 16 indicates that the video image from the camera 15 or the sensor 20 positions register a greater distance for one side of the razor accessory 10 than those measured on an opposing side of the razor accessory 10, the processor 16 may be configured to notify the user of a bias in the user's shaving stroke toward a leading edge or trailing edge. Thus, processor 16 may evaluate the activation histories of the various sensors 20 or camera 15 images to determine the skin/razor contact behavior observed in a given user's shaving technique.

The system may be configured to analyze the data from the razor accessory camera 15 or sensors 20 to determine an efficiency of a shaving stroke, or of a shaving technique of the user. For example, processor 16 may analyze tracking data from sensors 20 or image data from the camera 15 to determine whether the user is taking an efficient or otherwise optimal path during the shaving stroke (or too curved or too straight), whether the shaving stroke is too long or too short, and/or whether the tempo of the stroke is appropriate. Thus, processor 16 may determine whether the user is incorporating undesirable pauses in his or her shaving stroke, and/or whether the shaving stroke is too quick or too slow. Processor 16 may also determine, based on force measurements, whether the user is applying too much or too little force at any portion of a stroke.

Various mechanisms may be used to notify a user of suboptimal shaving techniques as described herein. For example, a user may open an application on a computer or smartphone 40 prior to commencement of shaving. As the user shaves, information about the shaving session may be generated and analyzed, and the results of the analysis may be displayed to the user via the application. For example, a picture of a face may appear on the application, and areas of the face may be indicated to the user as requiring more shaving or as being sufficiently shaved. Charts, text, colors, lights, pictures, or other suitable visual aids may indicate where the user does and does not need to shave, the percentage of shaving left or accomplished in a given area, or other suitable feedback, including, for example, whether the user is using shaving strokes that are too fast, too slow, whether the user is using too much or too little force during a shaving stroke, whether the user is using a suboptimal path during the shaving stroke, and/or whether the tempo of the user's shaving stroke may be improved. In some embodiments, the application may provide auditory or tactile feedback instead of, or in addition to, visual feedback. For example, a vibration or sound may indicate that a region of the body has been adequately shaved. In some embodiments, a voice may direct the user as to which portions of the user's face are becoming irritated.

In some embodiments, lights, noises, vibrations, and/or other visual, tactile, or auditory feedback may be provided on a separate device. For example, a light may go on when one or more blades of razor 1 is too dull or when a user is utilizing poor technique, or a light may turn from green to red to indicate the same information. Or a screen on the user device 40 may show similar visual indicators as those described above in reference to the application, or a vibration or sound may be generated by a separate device as described above.

In this way, razor accessory 10 may be configured to provide a user with real-time feedback regarding shaving technique and the useful life remaining of razor 1 or of a razor cartridge. This guidance and feedback may help to guide a shaving session to improve the user's shaving experience and to replace spent shaving equipment.

In an embodiment, determining the adequacy of shaving in a given body region may also take into account information not detected by razor accessory 10, for example, the type of hair a user has, the user's desired level of shave (e.g., whether the user wants stubble remaining, wants a clean shave, or wants to leave hair remaining in certain areas). Other information may include the type of cream or gel applied, the user's shaving history, the shape of the user's body, the density of hair on the user's body, the use history of blades (e.g., how sharp or new they are, types and blade number of a disposable razor or cartridge), the type of razor 1 used, the user's skin type (e.g., normal, dry, or sensitive), the user's age (which may affect, e.g., the sensitivity of the user's skin or the quality of the hair), or any other suitable information or combination of information. Some or all of this information may be input by the user and assessed along with data from the razor accessory 10 camera 15 or sensors 20, as will be described further below.

As described herein, the data collected by the camera 15 or the various sensors 20 and camera described herein may be transmitted to an IotT Platform 222 and Vendor Platform 223 for further study and analysis as described herein.

The information output from the control unit 16 and/or information captured by the camera 15 may be transmitted from the razor accessory (i) wirelessly via the transceiver 17 and/or (ii) via a wired connection through interface unit 21 for external power/data connection, to an IoT gateway 30. In addition, the transceiver 17 may be connected wirelessly and/or the interface 21 may be connected via a wired connection to a user device 40 (e.g., a mobile phone or a tablet).

In the example embodiment shown in FIG. 4, the circuitry of the razor accessor 10 may be configured as a unit that is Internet Protocol (IP) capable by itself, and the information flow from and to the razor accessor 10 is routed through, e.g., a WiFi router serving as the IoT gateway 220. Alternatively, the circuitry of the razor accessory 10 may be configured as a unit that is not Internet Protocol (IP) capable by itself, in which case the IoT gateway and/or the user device 40 connected thereto is configured to provide the interface via the Internet/cloud, e.g., translating protocols, encrypting, processing, managing data, etc. Other communication technologies may include cellular, satellite, Bluetooth, low-power wide-area networks (LPWAN), or connecting directly to the internet via ethernet, which examples are not limiting. The information may be routed from the IoT gateway 6020 to a vendor platform 223 via a cloud network 21 and an IoT platform 222. Although the IoT platform 222 is shown separately from the cloud network 221 in FIG. 4, the cloud network 221 may encompass the IoT platform 222. As used in this disclosure, the term "cloud network" encompasses the Internet and the associated connection infrastructure.

In an example embodiment, the user data (e.g., data and/or information regarding the user's hair thickness, skin type, skin contour, face contour, and/or image information captured by the camera 15 of the razor accessory 10 regarding a skin surface area to which the razor accessory 10 has been applied) may be stored (in part or in entirety) at the controller 16, the mobile device 40, the vendor platform 223 and/or at the IoT platform 222. In one example, the vendor platform 223 may (i) provide a suggestion, e.g., regarding optimum razor model, razor usage, and/or razor cartridge model, and/or (ii) transmit to the razor accessory 10 and/or the mobile device 40 information (visual, audio and/or data) regarding an individual user's razor use (e.g., whether a skin surface area imaged and/or scanned by the camera has been adequately shaved), skin type, hair characteristics, historically preferred razor cartridge model and/or quantity package, etc., which information may be output by the razor accessory 10 and/or the mobile device 40.

For example, the system may be configured to provide a notification to the notification unit 11 of the razor accessory 10 or to the mobile unit 40 that the user has shaved all the zones of the body part shaved (e.g. face, leg, underarm) and may discontinue shaving. The razor accessory 10 may be configured to provide a notification to the notification unit 11 that the user should continue to shave a surface area or zone, or that the user should employ a different stroke technique, for example longer stokes or less pressure. For another example, the system may be configured to generate report for the user identifying an optimal shaving product to the user device 40 and/or to a communication channel of the user (e.g, email, text).

FIG. 4 also illustrates various connection and communication paths between the razor accessory 10 and the external communication infrastructure 220, according to another embodiment of the present disclosure. In the embodiment shown in FIG. 4, the user device 40 may be (i) communicatively connected wirelessly to the transceiver 17, and/or (ii) communicatively connected via a hardwire connection to the interface unit 21. The camera 15 of the razor accessory is mechanically coupled to the razor 1, thereby enabling monitoring and feedback regarding the shaving surface while the razor accessory 10 is being used. In one communication path of the example embodiment illustrated in FIG. 4, information output from the control unit 16, sensor(s) 20, camera 15, and/or information regarding a user's physical characteristics (e.g., data and/or information regarding the user's hair thickness, skin type, skin contour, face contour, and/or image information captured by the camera 15 regarding the user's skin surface area) may be transmitted from the razor accessory 10 (e.g., while the user is using the razor 1 in a bathroom) to a user device 40. The mobile device 40 may be provided with client(s) (e.g., one or more software applications software or "apps") and perform some or all of the functionalities performed by the circuitry components of the razor 1 shown in FIG. 4, e.g., transmitting information via the Internet, data analysis, and/or storage of acquired information. The information received by the user device 40 may be routed to the IoT gateway 220, e.g., a WiFi router, and subsequently routed to a cartridge vendor platform 223 via the cloud network 221 and the IoT platform 222. Based on the information routed from the mobile device 240, the vendor platform 223 and/or the IoT platform 222 may provide appropriate feedback information, e.g., optimum razor model for the user, optimum razor cartridge model for the user, and/or information (visual, audio and/or data) regarding whether the user's skin surface area imaged by the camera 15 has been adequately shaved. Although the IoT platform 222 is shown separately from the cloud network 221 in FIG. 4, the cloud network 221 may encompass the IoT platform 222. Other communication technologies may include cellular, satellite, Bluetooth, low-power wide-area networks (LPWAN), or connecting directly to the internet via ethernet, which examples are not limiting. Some of the data transfer protocols that may be utilized include, e.g., hypertext transfer protocol (HTTP), message queuing telemetry transport (MQTT), and constrained application protocol (CoAP), which examples are not limiting.

In the example system illustrated in FIG. 4, information and/or processing of information may be shared among two or more of the razor accessory 10, the user device 40, the IoT gateway 220, the cloud network 2021, the IoT platform 6022 and/or the vendor platform 223. For example, the processing of information (regardless of the source of information) may be performed at the control unit 16, the user device 40, the cloud network 221, the IoT platform 222, and/or the vendor platform 223. In addition, input/output of information (e.g., audio, visual, and/or data) may be implemented via the razor accessory, a 2-way microphone/speaker may be provided on or in the razor accessory 10 (not shown), and/or the user device 40.

As an example of distributed functionality in the example system illustrated in FIG. 4, the image information (e.g., of the user's skin surface) captured by the camera 15 may be transmitted to the user device 40 (e.g., for display) and/or to the cartridge vendor platform 223 (e.g., for analysis). In addition, the sensor data from the electrical sensor 20 may be transmitted to the mobile device 40 (e.g., while the user is using the razor accessory 10), and the user's voice command and/or query may be inputted via the 2-way microphone/speaker may be provided on or in the razor accessory 10 or the microphone/speaker of the user device 40. In addition, the information contained in the response transmission from the vendor platform 223 may be outputted via the microphone/speaker of the razor accessory 10 (e.g., for audio), via the user device 40 (e.g., for audio, visual and/or text data), and/or via the display screen of the user device 40 (e.g., for visual and/or text data).

Figure 5A:
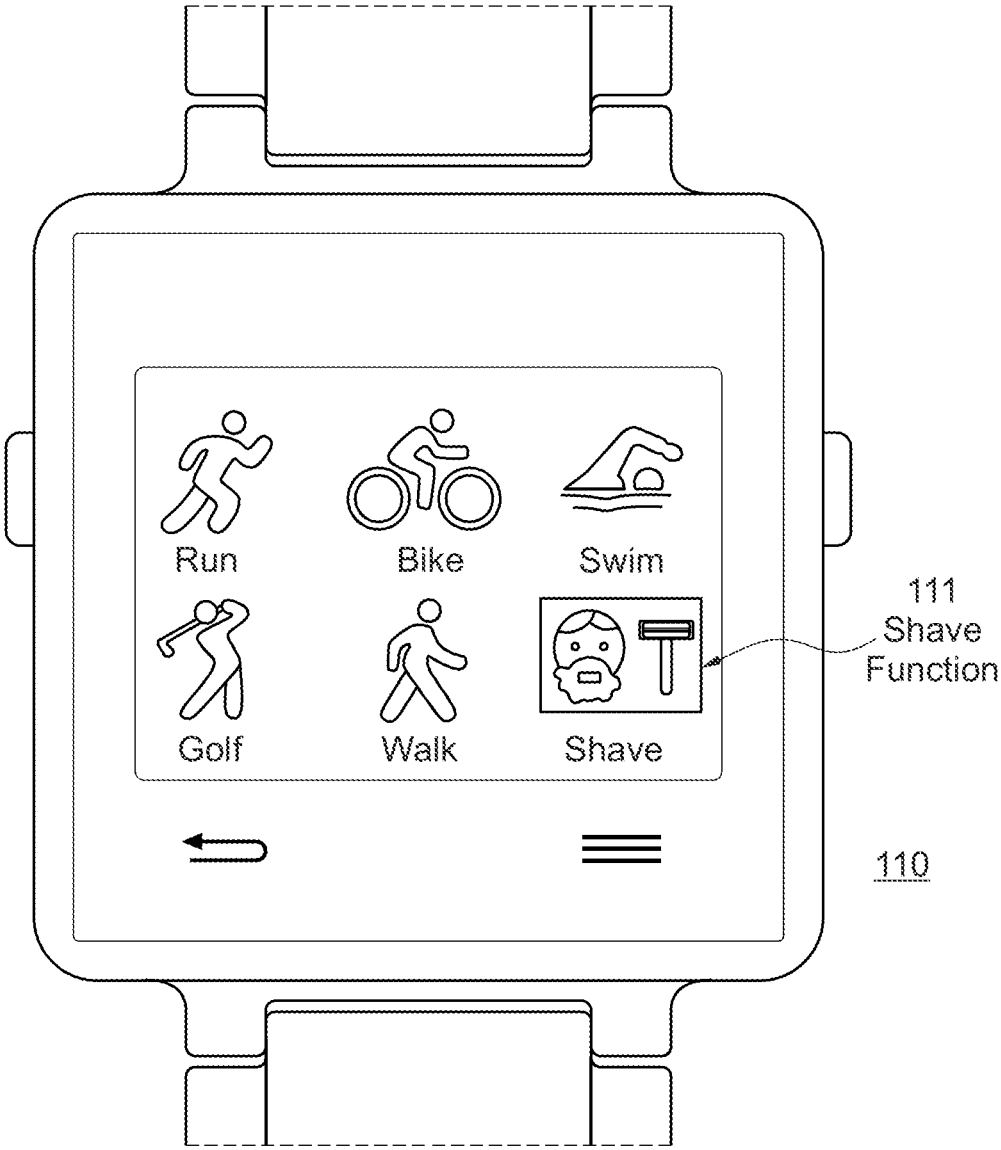
FIG. 5A illustrates a front view of a wearable computer device.
Figure 5B:
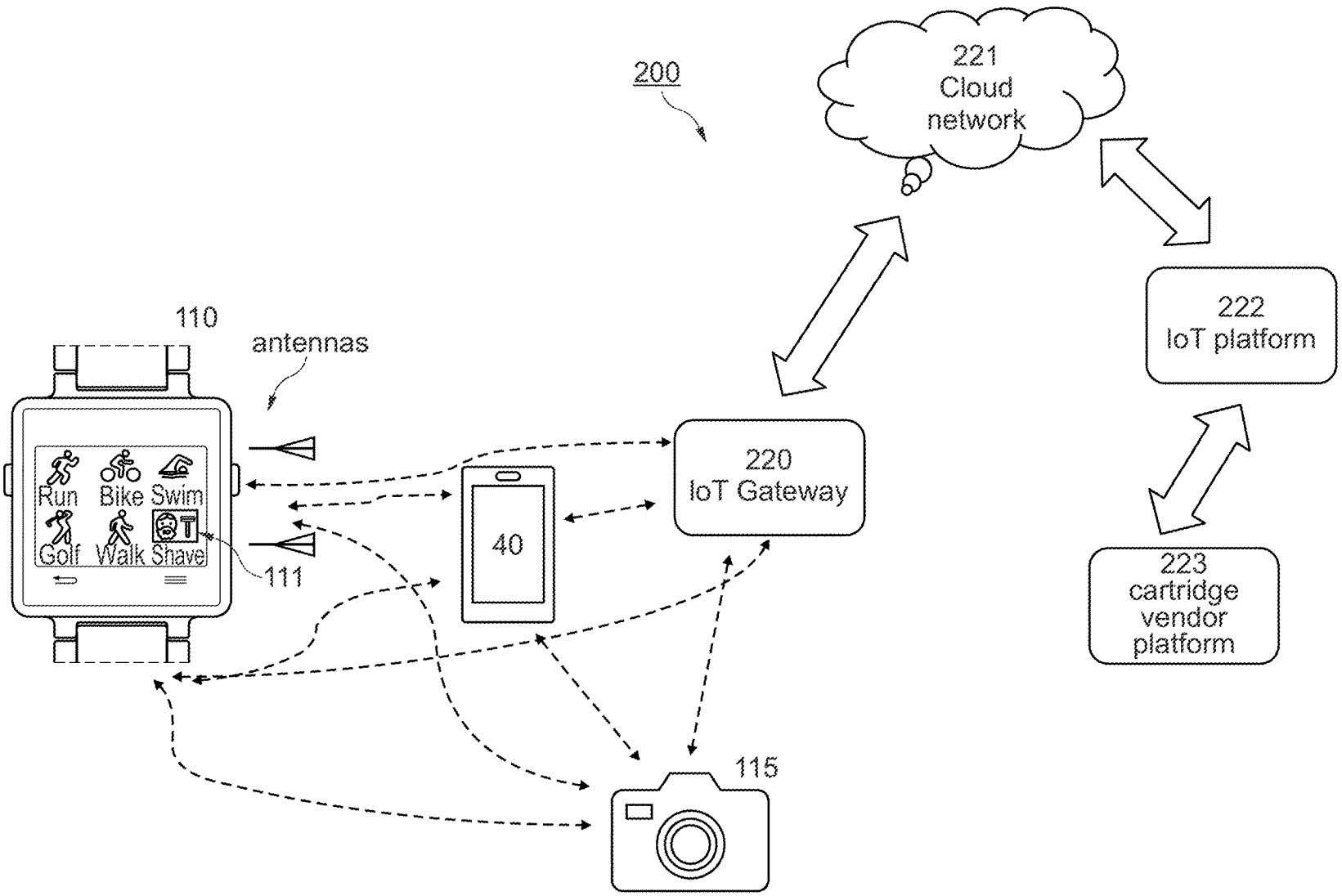
FIG. 5B is a schematic showing various electric/electronic components of a wearable computer and an external communication infrastructure according to an embodiment of the present disclosure.

In another embodiment, FIGS. 5A-5B illustrate a wearable computer device 110. In the example wearable computer device 110, the wearable computer device 110 is configured to be worn on the wrist, like a watch. The wearable computer device 110 may be configured to obtain and track biometric and activity data for user. Exemplary wearable computer devices include Apple Watch 1.0, 2.0, Fitbit wearable tracking devices (e.g.: Flex 2, Alta HR, Ionic, Versa, Ace, Surge, Blaze) Garmin wearable tracking devices (e.g. vivofit, vivoactive 3, Forerunner 645/645), and Android Wear™ devices. An exemplary wearable computer device 110 is described in U.S. Pat. App. Pub. 2017/0053542 entitled EXERCISED-BASED WATCH FACE AND COMPLICATIONS, filed on Jun. 15, 2016, the entirety of which is incorporated by reference hereby. In an embodiment, as shown in FIGS. 5A-B, the wearable computer device includes an application 111 configured to obtain, track, and report shaving data for a smart shaving system.

The wearable computer device 110 is configured with motion sensing technology. In an embodiment, the wearable computer device includes one or more activity sensors for detecting an activity of a user of the accessory on the razor. Activity sensors may include one or more of a type of sensor to detect motion, including, an accelerometer, a gyroscope, a motion sensor, or other sensor(s), and/or a combination thereof. While not shown, other sensor(s), may include any of a passive infrared sensor, an ultrasonic sensor, a microwave sensor, a tomographic motion detector, a light sensor, a timer, or the like.

For example, accelerometer, directional sensor, and gyroscope may further generate activity data that may be used to determine whether a user of razor 1 is engaging in an activity, i.e. shaving, is inactive, or is performing a particular gesture. For example, the sensor data may be used to allow the shaving system to determine a shaving stroke, a non-shaving backstroke, stroke pressure, stroke speed, blade rinsing time, number of strokes, number of strokes per shaving zone, etc.

The wearable computer device 110 may include a timer (not shown) that may be used, for example, to add time dimensions to various attributes of the detected physical activity, such as a duration of a user's physical activity (e.g. shaving time, blade washing/rinsing time) or inactivity, time(s) of a day when the activity is detected or not detected, etc.

In an embodiment, the application 111 is configured to have the device sensors track repeated motions or strokes of shaving. The user may select the shaving application 111 on the wearable computer device, which then measures and tracks strokes and other details by wrist movement during shaving.

In an embodiment, a shaver may be supplied with an RFID tag (not shown). The wearable computer device 110 may be configured to active the application if the RFID tag is detected in the razor 1.

In embodiments, data detected by wearable computer device 110 may be analyzed in conjunction with the images of the user taken before and/or during a shaving session, for example using camera 115. The data may be analyzed in conjunction with images and/or mapping of the region of the user's body to be shaved, e.g., the face. For example, before shaving takes place, a user may download an application on his or her smartphone or computer user device 40. When the user begins shaving, the wearable computer device 110 or the application on the user device 40 may prompt the user to active the camera 115 or the user device 40 camera to start photographing or uploading a video before or during shaving. As the user shaves, the camera 15 takes photos or video as the camera is moved at different angles relative to the body region, or as the user moves the body region relative to the camera.

For another example, in an embodiment, as discussed herein, the wearable computer device 110 may include or may be otherwise coupled to one or more processors. Data captured by sensors may be stored in a memory and analyzed by processor(s). In some embodiments, data from sensors on the wearable computer device may be transmitted to a separate user device 40, smartphone or computer. In exemplary embodiments, data from camera 115 or sensors 20 may be transmitted to user device 40 equipped with software configured to analyze the received data to provide information to the user pertaining to the user's shaving technique, a number of shaving strokes taken by the user (or distance razor 1 has travelled or speed of razor 1 during a shave stroke), and/or whether the user would benefit from one or more specialized items to optimize shaving performance and comfort. The processor and/or memory may be located on any component of the shaving system, for example, in wearable computer device 110 itself, a user device 40 such as a smartphone, or a computer, and the components of the shaving system may transmit any stored or detected data to the processor and/or to an external network 200 for analysis as described herein.

As set forth above, the system may be configured to determine a usage of razor 1 based on the input received from wearable computer device, camera 115 or sensors 20 over time. For example, processors of the wearable computer device 110 or the user device 40 may be configured to track an overall distance travelled by razor accessory 10 and/or a number of shaving strokes that razor 1 has been used for. For example, when the processor determines that wearable computer device 110 running the shaving application has exceeded a usage threshold based distance, or based on a calculated number of shaving strokes taken, the processor may generate an alert, for example on the wearable computer device 110 or the user device 40.

Differences in the tracking data received from each of sensors 20 may be used by the processor to analyze shaving strokes taken by the user. For example, over the course of a shaving stroke, the varying movements measured by the wearable computer device 110 sensors are used by the processor determine that the user is applying too much force to one or more of leading edge, a trailing edge, or either side of the razor 1 while shaving. The uneven application of force may result in cuts, skin irritation, and/or excessive shaving strokes. Similarly, sensors 20 may detect that the user's shaving stroke includes a component of side-to-side movement (e.g., movement in a direction parallel to one or more blades of the razor 1). Such side-to-side movements, or shave strokes including components of side-to-side movement, may result in nicks and/or cuts of the user's skin. In such instances, therefore, the processor may be configured to provide a notification or other feedback to the user via the wearable computer device 110 or the user device 40 to adjust the shave stroke or otherwise change a direction of movement of the razor 1. Thus, the wearable computer device 110 or user device 40 may alert the user of such abnormalities via the various feedback mechanisms described herein. For example, if processor 16 indicates that the sensor positions in the wearable computer device 110 register an angular position in the wearable computer device 110 indicating a bias, the processor may be configured to notify the user of a bias in the user's shaving stroke toward a leading edge or trailing edge. Thus, processor may evaluate the activation histories of the various sensors as well as camera 115 images to determine the skin/razor contact behavior observed in a given user's shaving technique.

The system may be configured to analyze the data from the razor accessory camera 115 or sensors 20 to determine an efficiency of a shaving stroke as well as force measurements similar to those described above with respect to the razor accessory 10 measurements.

Various mechanisms may be used to notify a user of suboptimal shaving techniques as described herein. For example, a user may open an application 111 on a wearable computer device 110, which may be synced to a computer or smartphone or other user device 40, prior to commencement of shaving. As the user shaves, information about the shaving session may be generated and analyzed, and the results of the analysis may be displayed to the user via the application. For example, a picture of a face may appear on the application, and areas of the face may be indicated to the user as requiring more shaving or as being sufficiently shaved. Charts, text, colors, lights, pictures, or other suitable visual aids may indicate where the user does and does not need to shave, the percentage of shaving left or accomplished in a given area, or other suitable feedback, including, for example, whether the user is using shaving strokes that are too fast, too slow, whether the user is using too much or too little force during a shaving stroke, whether the user is using a suboptimal path during the shaving stroke, and/or whether the tempo of the user's shaving stroke may be improved. In some embodiments, the application may provide auditory or tactile feedback instead of, or in addition to, visual feedback. For example, a vibration or sound may indicate that a region of the body has been adequately shaved. In some embodiments, a voice may direct the user as to which portions of the user's face are becoming irritated.

In this way, wearable computer device 110 or user device 40 may be configured to provide a user with real-time feedback regarding shaving technique and the useful life remaining of razor 1 or of a razor cartridge. This guidance and feedback may help to guide a shaving session to improve the user's shaving experience and to replace spent shaving equipment.

In an embodiment, determining the adequacy of shaving in a given body region may also take into account information not detected by wearable computer device 110 or camera 115, similar to that described above with respect to the razor accessory 10 measurements. Some or all of this information may be input by the user and assessed along with data from the wearable computer device 110, user device 40, or camera 115, as will be described further below.

As described herein, the data collected by the wearable computer device 110, user device 40, or camera 115 described herein may be transmitted to an IotT Platform 222 and Vendor Platform 223 for further study and analysis as described herein.

Figure 6:
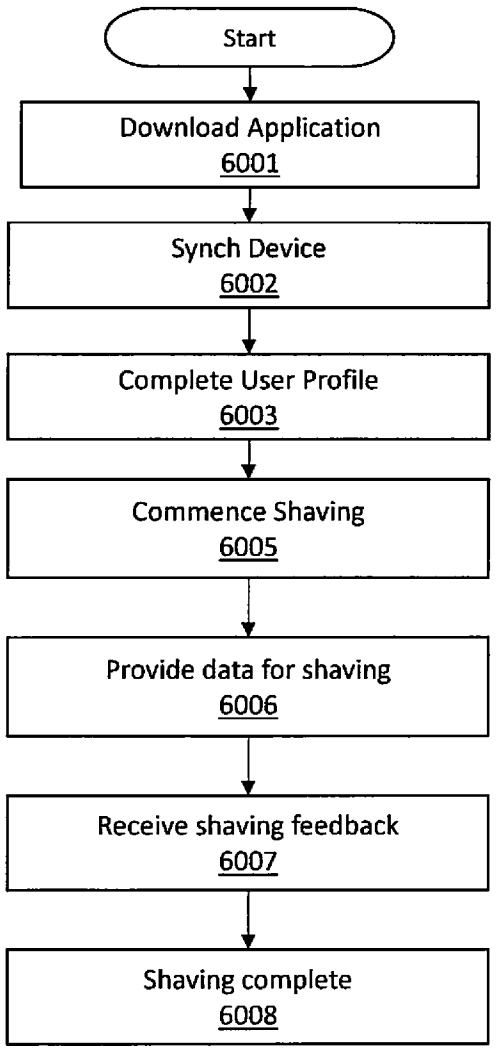
FIG. 6 is a flow chart of a method according to an exemplary embodiment.

FIG. 5B illustrates various connection and communication paths between the wearable computer device 110 and the external communication infrastructure 200, according to another embodiment of the present disclosure. In the embodiment shown in FIG. 6, an imaging device such as a camera 115 (which may include a display element) is provided separately from the wearable computer device 110 and may be used completely independently of the wearable computer device. The imaging device may include a camera 15 selected from one or more cameras or camera types, for example, an HD camera, 2D camera, a 3D camera, and so on. Alternatively, as shown in FIG. 6, the camera 115 and/or a user device 40 (e.g. smart phone) with a camera may be (i) communicatively connected wirelessly to a transceiver 17 or by hardwire connection to the wearable computer device. In the example embodiment shown in FIG. 5B, the wearable computer device 110, the user device 40 and/or the camera 115 may be configured as Internet Protocol (IP) capable devices.

In one communication path of the example embodiment illustrated in FIG. 6, information output from the wearable computer device 110 sensors may be transmitted from the wearable computer device 110 (e.g., while the user is using the razor 1 while wearing the wearable computer device 110 in a bathroom) and/or the camera 115 to the user device 40. In one example, the camera 115 communicatively connected to the wearable computer device 110 may be used by a user to perform a 3D scan of a body area to be shaved (e.g. face, legs, etc.) in order to (i) determine whether the skin surface of the particular body area has been adequately shaved and/or (ii) guide the user while shaving (by having performed and stored a 3D scan prior to shaving).

The wearable computer device 110 and/or the user device 40 may be provided with one or more software applications 111 or "app") and perform some or all of the functionalities performed by the wearable computer device 110 shown in FIG. 6, e.g., transmitting information via the Internet, data analysis, and/or storage of acquired information. In an embodiment, the information received by the user device 40 from the wearable computer device 110 may be routed to the IoT gateway 2020, e.g., a WiFi router, and subsequently routed to a vendor platform 223 via the cloud network 221 and the IoT platform 222. In an embodiment, the information may be sent directly from the wearable computer device 110 to the IoT gateway 220 and subsequently routed to a vendor platform 223 via the cloud network 2021 and the IoT platform 2022. Based on the information routed from the mobile device 240, the vendor platform 223 and/or the IoT platform 222 may provide appropriate feedback information, e.g., optimum razor model for the user, optimum razor cartridge model for the user, and/or information (visual, audio and/or data) regarding whether the user's skin surface area imaged by the camera 115 has been adequately shaved. Although the IoT platform 2022 is shown separately from the cloud network 2021 in FIG. 6, the cloud network 221 may encompass the IoT platform 222. Other communication technologies may include cellular, satellite, Bluetooth, low-power wide-area networks (LPWAN), or connecting directly to the internet via ethernet, which examples are not limiting. Some of the data transfer protocols that may be utilized include, e.g., hypertext transfer protocol (HTTP), message queuing telemetry transport (MQTT), and constrained application protocol (CoAP), which examples are not limiting.

In another communication path of the example embodiment illustrated in FIG. 6, information output from wearable computer device 110 to the camera 115, which may be provided with software applications 111 and perform some or all of the functionalities performed by the wearable computer device 110 and/or the user device 40 as also described with respect to FIG. 6, e.g., transmitting information via the Internet, data analysis, and/or storage of acquired information. The sensor information received from the wearable computer device 110, along with the image information captured by the camera 115 regarding the user's skin surface area, may be routed to the IoT gateway 220, e.g., a WiFi router, and subsequently routed to a cartridge vendor platform 223 via the cloud network 2021 and the IoT platform 222. The information received by the camera 115, along with the image information captured by the camera 115 regarding the user's skin surface area, may be routed to the IoT gateway 220, e.g., a WiFi router, and subsequently routed to a vendor platform 223 via the cloud network 2021 and the IoT platform 222. Based on the information routed from the camera 115, the vendor platform 223 and/or the IoT platform 222 may provide appropriate feedback information, e.g., optimum razor model for the user, optimum razor cartridge model for the user, and/or information (visual, audio and/or data) regarding whether the user's skin surface area imaged by the camera 115 and/or tracked by the sensor(s) 20 has been adequately shaved. Other communication technologies may include cellular, satellite, Bluetooth, low-power wide-area networks (LPWAN), or connecting directly to the internet via ethernet, which examples are not limiting.

In the example system illustrated in FIG. 5B, information and/or processing of information may be shared among two or more of the wearable computer device 110, the camera 115, the user device 240, the IoT gateway 220, the cloud network 221, the IoT platform 222 and/or the vendor platform 223. For example, the processing of information (regardless of the source of information) may be performed at the wearable computer device 110, the camera 115, the mobile device 240, the cloud network 221, the IoT platform 222, and/or the vendor platform 223. In addition, input/output of information (e.g., audio, visual, and/or data) may be implemented via the camera 115, a 2-way microphone/speaker may be provided on or in the wearable computer device 110, and/or the user device 40.

As an example of a distributed configuration in the example systems illustrated in FIG. 5B, motion data captured by the sensor data from the electrical sensor(s) 20 may be transmitted to the camera 115 and/or the mobile device 40 (e.g., while the user is using wearable computer device to shave), and the user's voice command and/or query may be inputted via the 2-way microphone/speaker may be provided on or in the wearable computer device 110 or the microphone/speaker of the mobile device 40. In addition, the information contained in the response transmission from the vendor platform 223 may be outputted via the microphone/speaker of the watch 110 (e.g., for audio), via the user device 40 (e.g., for audio, visual and/or text data), and/or via the display screen of the wearable computer device 110, the mobile device 40, or the camera 115 (e.g., for visual and/or text data).

An exemplary razor accessory 10 or wearable computer device 110 including a smart shaving application may be used in the manner shown in the process flow 600 of FIG. 6. Those of ordinary skill in the art will recognize that one or more steps of the method depicted in FIG. 6 may be omitted or performed out of the order depicted in FIG. 6. First, a user may download a shaving application to a smartphone, computer, or other user device 40, or a wearable computer device 110 at block 6001. At block 6002, the user may sync the razor accessory 10 or wearable computer device 110 including the shaving application 111 with the shaving application on the smartphone, computer, or other user device 40. At block 6003, a user may then complete a user profile. Completing a user profile may include answering a series of questions or prompts. Exemplary questions in a user profile may include questions regarding type of hair a user has, the user's desired level of shave (e.g., whether the user wants stubble remaining, wants a clean shave, or wants to leave hair remaining in certain areas), the type of cream or gel typically used, the user's shaving history, the shape of the user's body, the density of hair on the user's body, the use history of the user's blades (e.g., how sharp or new they are), the type of shaver 1 the user has or commonly purchases, the user's skin type (e.g., normal, dry, or sensitive), the user's age (which may affect, e.g., the sensitivity of the user's skin or the quality of the hair), or any other suitable information or combinations of information. The user may input information via any suitable means. For example, the user may type information into the shaving application or activate a camera to scan a bar code of the shaver type. The user may be able to go back into the application and modify the answers at a later date, e.g., if the answers to the questions change over time.

At block 6005, once the user profile is complete, the user may commence shaving. As discussed above, images or sensor data for the region to be shaved may be captured during the shaving process.

At block 6006, in embodiments, the method may also include providing shaving data such as sensor data or image data as described herein. As will be appreciated, in embodiments for the razor accessory 10 comprising a camera 15, image data may be provided during shaving as described herein. In other embodiments, for example in embodiments for the wearable computer device 110, a user may upload existing pictures or videos and/or generate and upload new pictures and/or videos using one or more of a smartphone, computer, external camera, prior to shaving.

At block 6007, as the user shaves, he or she may receive feedback from razor accessory 10, wearable computer device 110, and/or the application on a user device 40 to determine the adequacy of shaving in a given area. Based on the feedback, the user may continue or discontinue shaving in a certain area of the body region. The user may continue shaving until the feedback indicates that adequate shaving has been achieved for all areas of the body region. At that time, at block 6008, the user may stop shaving when shaving feedback indicates shaving is complete.

Figure 7:
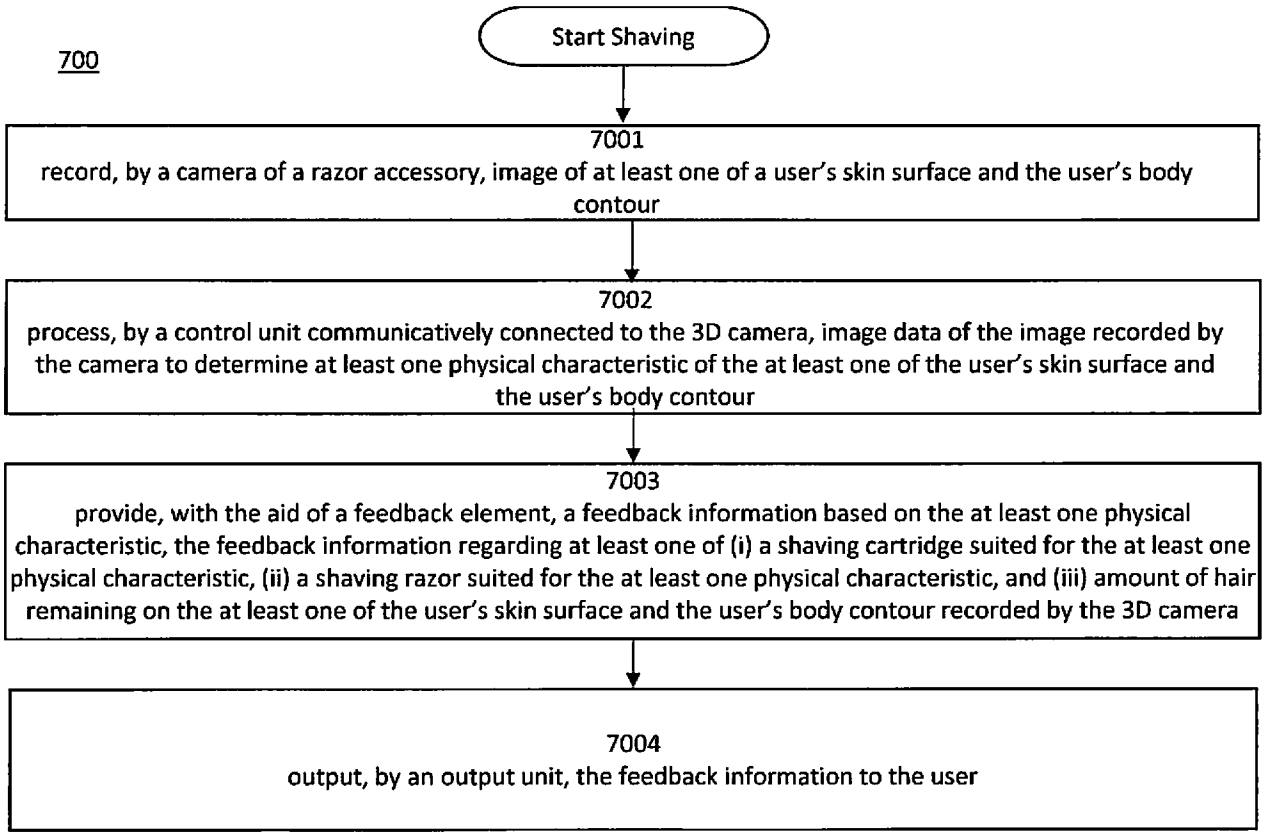
FIG. 7 is a logic flow chart of a method according to an exemplary embodiment.

FIG. 7 illustrates a logic flow 700 of an example method of using a razor accessory comprising a camera to assist a user, e.g., in connection with shaving and/or shaving razor selection/replacement. At a start block, the user activates the razor accessory and starts shaving, for example by using an activation device on a shaving application on the user device 40 or on the razor accessory 10. At block 7001, image of at least one of a user's skin surface and the user's body contour is recorded and/or scanned by a camera (e.g., camera 15 of the razor accessory 10 or a separate camera 115 or a camera of the mobile device 40). At block 7002, a control unit communicatively connected to the camera (e.g., the control unit 16, a control unit of the camera 115, a control unit of the user device 40, a control unit of the wearable computer device 110, a control unit of the vendor platform 223, and/or a control unit of the IoT platform 222) processes image data of the image recorded by the camera to determine at least one physical characteristic of at least one of the user's skin surface and the user's body contour (e.g., of the chin area, neck area, leg area, etc.). In an embodiment, a razor accessory also including sensors 20 may transmit sensor data to the control unit. At block 7003, a feedback information is provided (e.g., with the aid of a feedback element such as the vendor platform 223 and/or the control unit of the vendor platform 223) based on the at least one physical characteristic, the feedback information regarding at least one of (i)

a shaving cartridge suited for the at least one physical characteristic, (ii) a shaving razor suited for the at least one physical characteristic, and (iii) amount of hair remaining on the at least one of the user's skin surface and the user's body contour recorded by the camera. The feedback information may be transmitted from the feedback element via the Internet and the Internet gateway 220 to the user device 40, camera 115, or wearable computer device 110. At block 7004, an output unit (e.g., a display of the camera 115, a display of the camera of the mobile device 40, a microphone/speaker of the mobile device 40, the wearable computer device 110, and/or a microphone/speaker of the razor accessory 10) outputs the feedback information to the user. The logic flow 700 shown in FIG. 7 and described above assumes that information and/or processing of information may be shared among two or more of the razor accessory 10, the wearable computer device 110, the camera 115, the mobile device 40, the IoT gateway 2020, the cloud network 221, the IoT platform 222 and/or the cartridge vendor platform 2023.

Figure 8:
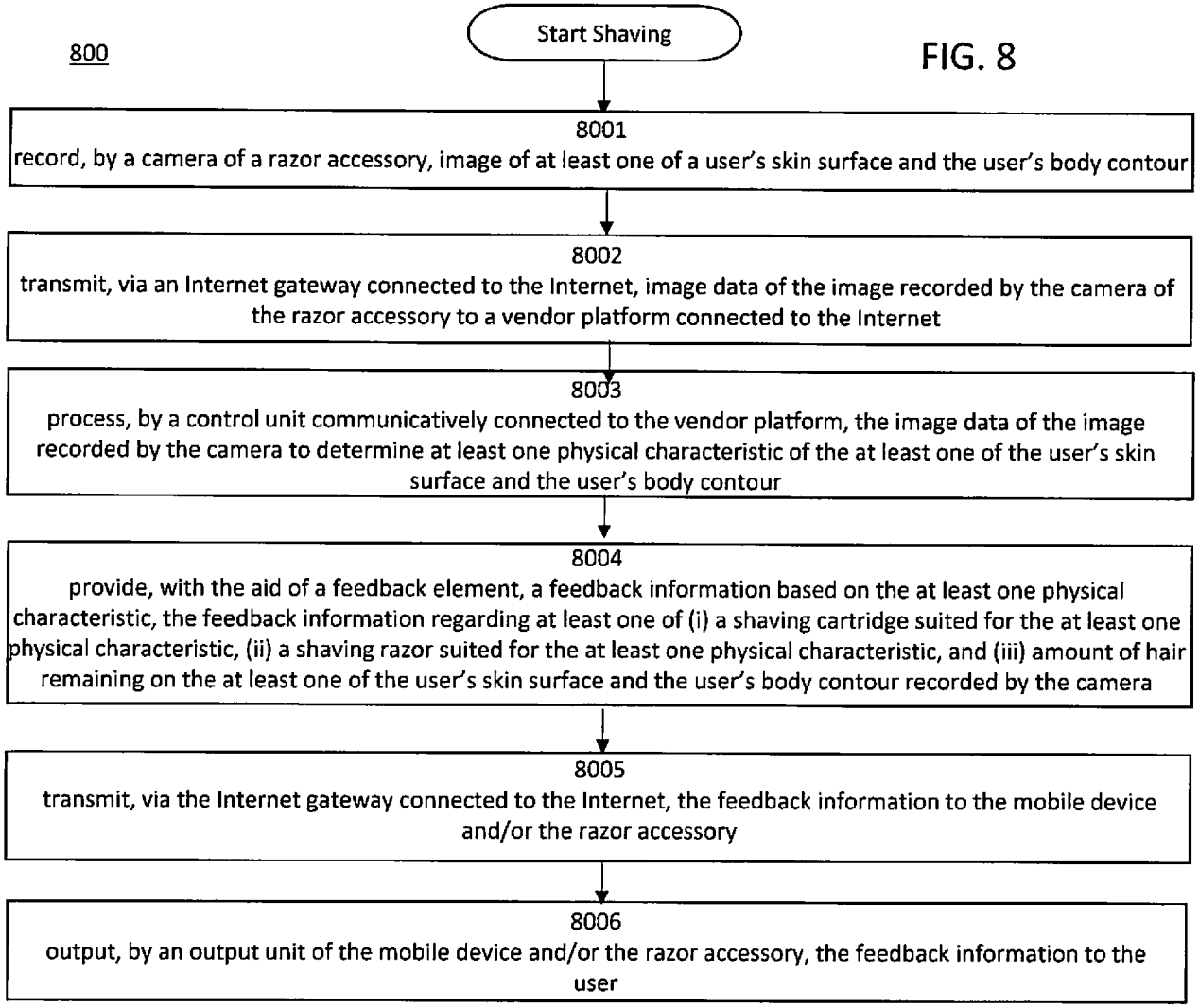
FIG. 8 is a logic flow chart of a method according to another exemplary embodiment.

FIG. 8 illustrates a logic flow 800 of another example method of using a camera of the razor accessory 10 to assist a user. At a start block, the user activates the razor accessory 10 and starts shaving, for example by using an activation device on a shaving application on the user device 40 or on the razor accessory 10. At block 8001, image of at least one of a user's skin surface and the user's body contour is recorded and/or scanned by a camera 15 of the razor accessory 10. At block 8002, image data of the image recorded by the camera is transmitted, via an Internet gateway connected to the Internet, to a vendor platform (e.g., vendor platform 2023) connected to the Internet. At block 8003, a control unit communicatively connected to the vendor platform (e.g., the control unit 16, a control unit of the mobile device 40 a control unit of the vendor platform 223, and/or a control unit of the IoT platform 222) processes image data of the image recorded by the camera 15 to determine at least one physical characteristic of the at least one of the user's skin surface and the user's body contour. In an embodiment, a razor accessory also including sensors 20 may transmit sensor data to the control unit. At block 8004, a feedback information is provided (e.g., with the aid of a feedback element such as the vendor platform 223 and/or the control unit of the cartridge vendor platform 223) based on the at least one physical characteristic, the feedback information regarding at least one of (i) a shaving cartridge suited for the at least one physical characteristic, (ii) a shaving razor suited for the at least one physical characteristic, and (iii) amount of hair remaining on the at least one of the user's skin surface and the user's body contour recorded by the camera 15 of the razor accessory 10. At block 8005, the feedback information is transmitted, via the Internet gateway connected to the Internet, to the user device 40 and/or the razor accessory 10. At block 8006, an output unit of the user device 40 (e.g., a display of the mobile device 40) and/or the razor accessory 10, e.g., amicrophone/speaker of the razor accessory 10, outputs the feedback information to the user. The logic flow 800 shown in FIG. 8 and described above assumes that information and/or processing of information may be shared among two or more of the razor accessory 10 having the camera 15, the user device 40 the IoT gateway 220, the cloud network 221, the IoT platform 222 and/or the cartridge vendor platform 223.

Figure 9:
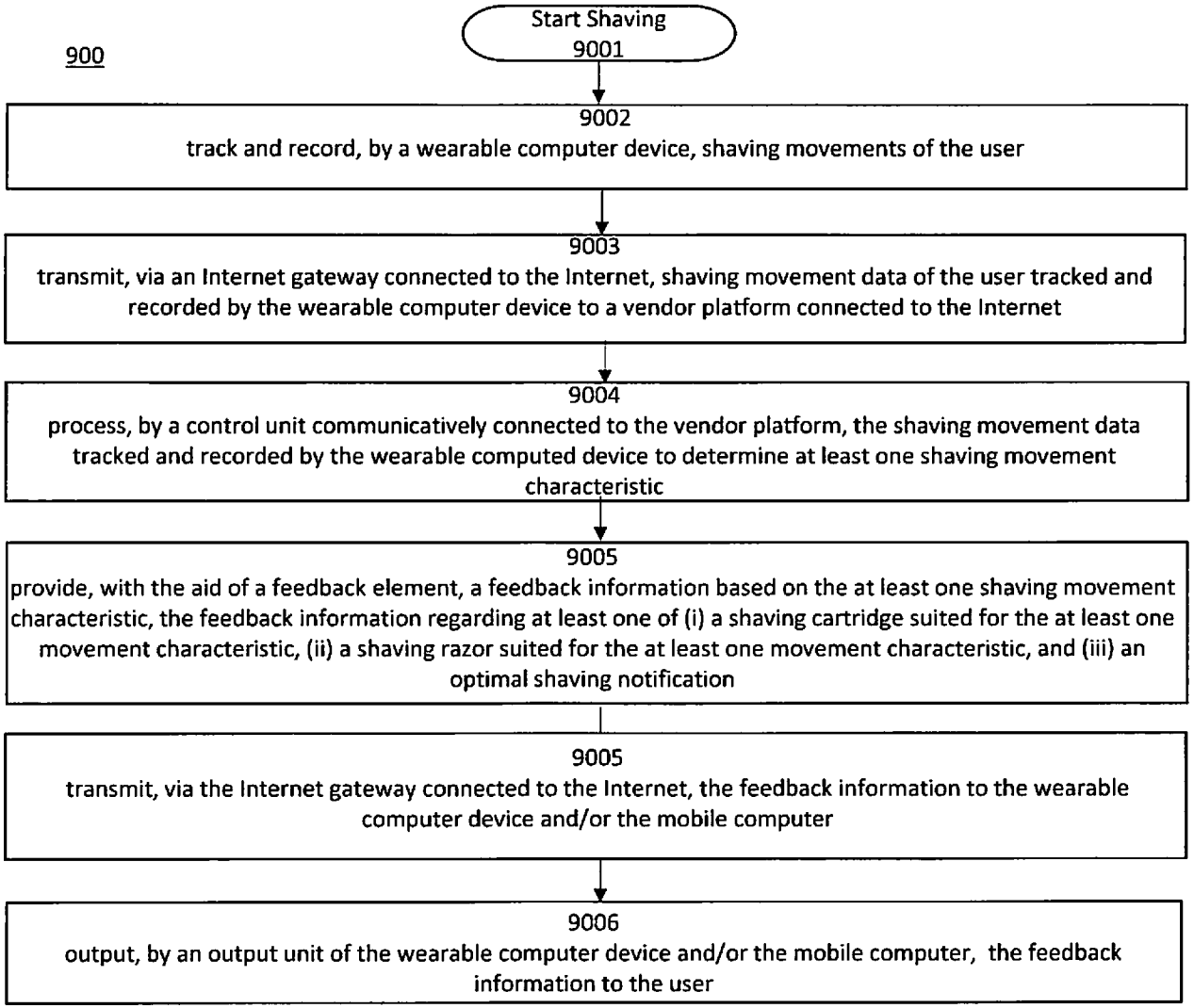
FIG. 9 is a logic flow chart of a method according to yet another exemplary embodiment.
Figure 10:
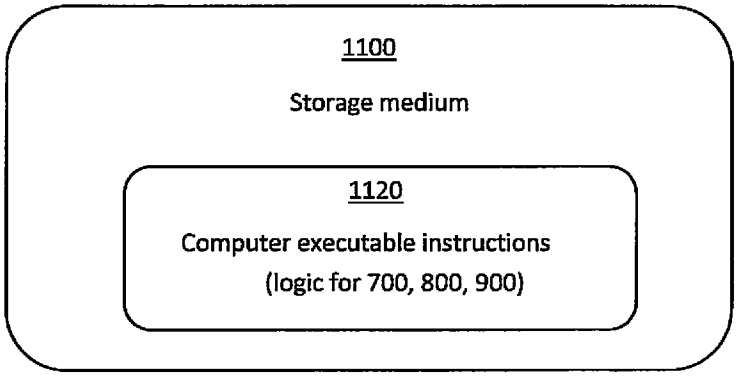
FIG. 10 is a computer-readable storage medium according to an exemplary embodiment herein.

FIG. 9 illustrates a logic flow 900 an example method of using a wearable computer 110 to assist a user, e.g., in connection with shaving and/or shaving razor selection/replacement. At block 9001 a user starts a shaving application on the wearable computer device and starts shaving. At block 9002, the wearable computer device tracks 110 and records the shaving movement of the user as he or she shaves. At block 9003, shaving movement data is transmitted, via an Internet gateway connected to the Internet, to a vendor platform (e.g., vendor platform 223) connected to the Internet. At block 9004, a control unit communicatively connected to the vendor platform (a control unit of the wearable computer device 110, a control unit of the camera 115, a control unit of the mobile device 40, a control unit of the vendor platform 223, and/or a control unit of the IoT platform 222) processes shaving movement data recorded by the wearable computer device to determine at least one shaving movement characteristic. At block 9005, a feedback information is provided (e.g., with the aid of a feedback element such as the vendor platform 223 and/or the control unit of the vendor platform 223) based on the at least one shaving movement characteristic, the feedback information regarding at least one of (i) a shaving cartridge suited for the at least one movement characteristic, (ii) a shaving razor suited for the at least one movement characteristic, and (iii) an optimal shaving notification. At block 9005, the feedback information is transmitted, via the Internet gateway connected to the Internet, to the wearable computer device 110 and/or a user device 40. At block 9006, an output unit of the wearable computer device or the mobile device 40, for example a display, haptic interface, or microphone/speaker, outputs the feedback information to the user. The logic flow 900 shown in FIG. 9 and described above assumes that information and/or processing of information may be shared among two or more of the wearable computer device 110, the mobile device 40, the IoT gateway 220, the cloud network 221, the IoT platform 222 and/or the cartridge vendor platform 223.

It should be noted that parts of the example techniques 600, 700, 800, 900, 1300, and 1400 illustrated in FIGS. 6-9 and 14-15 may be modified and/or combined in part and/or entirely. For example, in an embodiment, image data recorded and/or scanned by a camera as described in conjunction with logic flows 700 and/or 800 may be combined with movement tracking as described with respect to logic flow 900 determine both physical characteristic(s) and movement characteristic(s) for feedback information. As described herein, the razor accessory may be provided with one or more sensors to track shaving movement duration. Accordingly, the wearable computer device 110 tracks and/or sensors in the razor accessory 10 may track and records the shaving movement of the user as he or she shaves.

Figure 11:
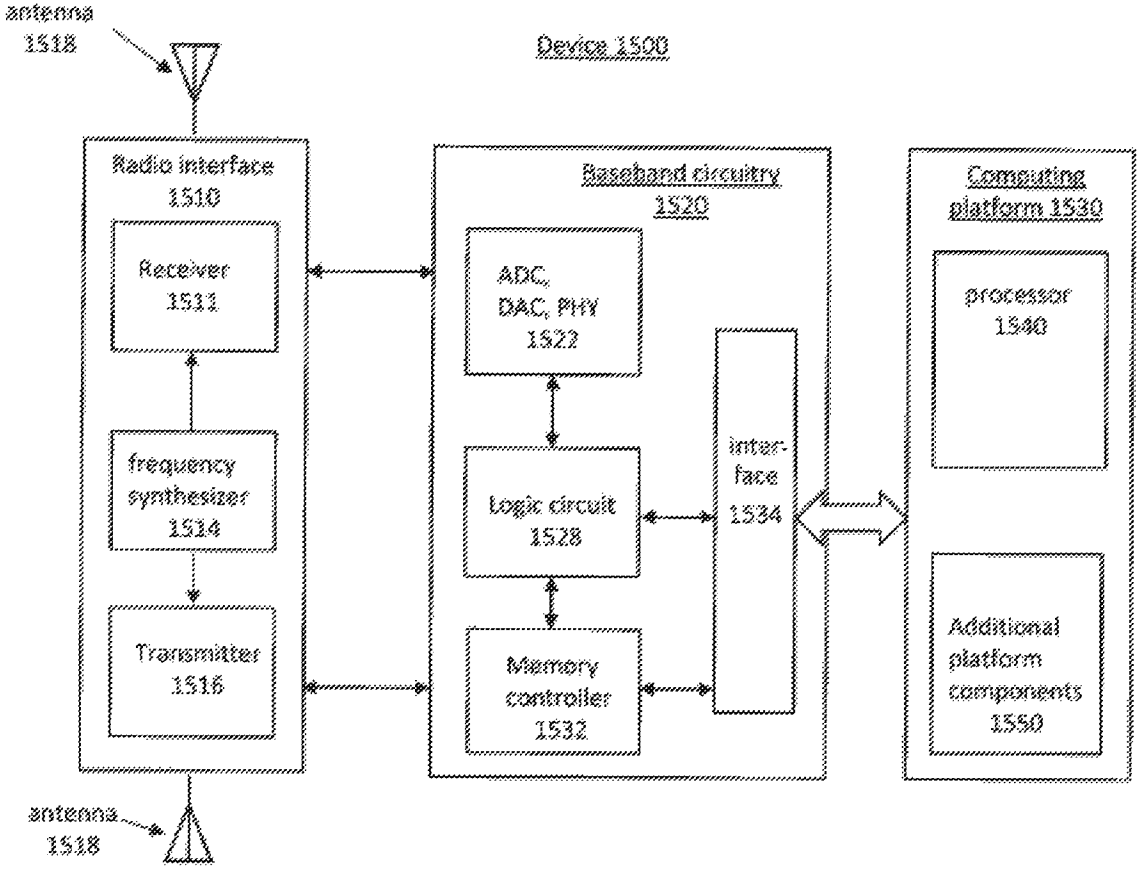
FIG. 11 is an embodiment of an exemplary communication device.

FIG. 11 illustrates an embodiment of a communications device 1500 which may implement one or more of logic flow 700, logic flow 800, and logic flow 900, storage medium 1100, controller 16, wearable computer device 110, the user device 40, and one or more functionalities of the circuitry of razor accessory 10, according to one or more embodiments. In an example embodiment, communication device 1500 may comprise a logic circuit 1528 which may include physical circuits to perform operations described for one or more of logic flow 700, logic flow 800, and logic flow 900, for example. In addition, communication device 1500 may include a radio interface 1510, baseband circuitry 1520, and computing platform 1530. However, the embodiments are not limited to this example configuration.

Communication device 1500 may implement some or all of the structure and/or operations for one or more of logic flow 700, logic flow 800, and logic flow 900, storage medium 1100, controller 15, wearable computer device 110, user device 40, one or more functionalities of the circuitry of razor accessory 110, and logic circuit 1528 in (i) a single computing entity, e.g., a single device, or (ii) in a distributed manner. In the latter case, communication device 1500 may distribute portions of the structure and/or operations for one or more of logic flow 700, logic flow 800, and logic flow 900, storage medium 1100, controller 15, wearable computer device 110, user device 40, one or more functionalities of the circuitry of razor accessory 110, and logic circuit 1528 across multiple computing platforms and/or entities using a distributed system architecture, e.g., a master-slave architecture, a client-server architecture, a peer-to-peer architecture, a shared database architecture, and the like. The embodiments are not limited in this context.

Storage medium 1110 further includes one or more data storage which may be utilized by communication device 1100 to store, among other things, applications 111 and/or other data. Application 111 may employ processes, or parts of processes, similar to those described in conjunction with logic flow 700, logic flow 800, and logic flow 900, to perform at least some of its actions.

In an example embodiment, radio interface 1510 may include one or more component(s) adapted to transmit and/or receive single-carrier or multi-carrier modulated signals such as CCK (complementary code keying), OFDM (orthogonal frequency division multiplexing), and/or SC-FDMA (single-carrier frequency division multiple access) symbols. Radio interface 1510 may include, e.g., a receiver 1511, a frequency synthesizer 1514, a transmitter 1516, and one or more antennas 1518. However, the embodiments are not limited to these examples.

Baseband circuitry 1520, which communicates with radio interface 1510 to process receive signals and/or transmit signals, may include a unit 1522 comprising an analog-to-digital converter, a digital-to-analog converter, and a baseband or physical layer (PHY) processing circuit for physical link layer processing of receive/transmit signals. Baseband circuitry 1520 may also include, for example, a memory controller 1532 for communicating with a computing platform 1530 via an interface 1534.

Computing platform 1530, which may provide computing functionality for device 1500, may include a processor 1540 and other platform components 1750, e.g., processors, sensors memory units, chipsets, controllers, peripherals, interfaces, input/output (I/O) components, power supplies, and the like.

Device 1500 may be, e.g., a mobile device, a smart phone, a fixed device, a machine-to-machine device, a personal digital assistant (PDA), wearable computer device, a mobile computing device, a user equipment, a computer, a network appliance, a web appliance, consumer electronics, programmable consumer electronics, game devices, television, digital television, set top box, wireless access point, base station, subscriber station, mobile subscriber center, radio network controller, router, hub, gateway, and the like. These examples are not limiting.

In at least one of the various embodiments, device 1500 may be arranged to integrate and/or communicate with vendor platform or third-party and/or external content provider services using API's or other communication interfaces provided by the platform(s). For example, vendor platform 223 provider service may offer a HTTP/REST based interface that enables vendor platform 223 to determine various events that may be associated with feedback provided by the platform.

Figure 12:
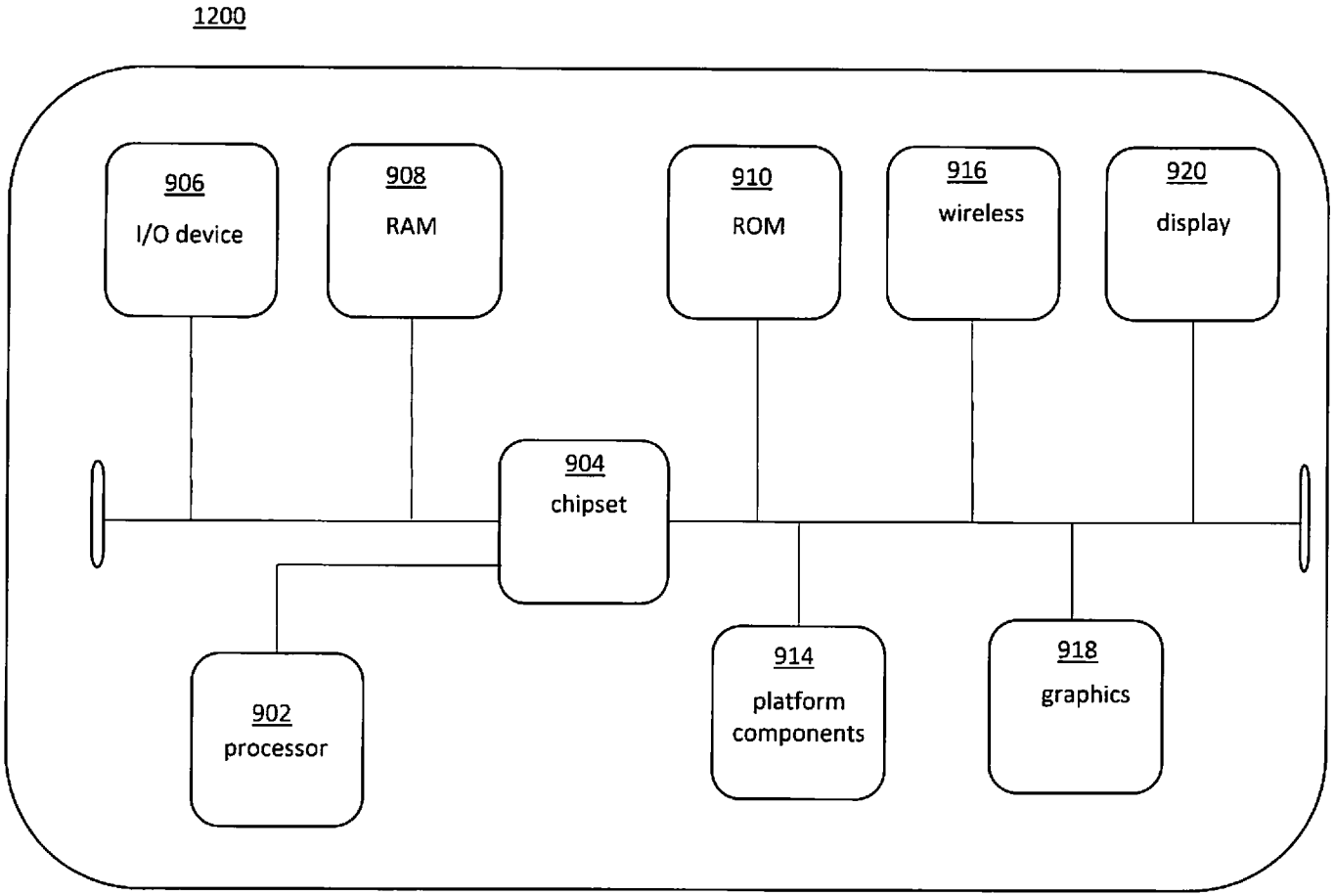
FIG. 12 is an exemplary embodiment of a system schematic of the present disclosure.

FIG. 12 is an exemplary system embodiment configured as a platform 1200, which may include, e.g., a processor 902, a chipset 904, an I/O (input/output) device 906, a RAM (random access memory) 908, e.g., DRAM (dynamic RAM), and a ROM (read only memory) 910, a wireless communications chip 916, a graphics device 918, and a display 920, and other platform components 914 (e.g., a cooling system, a heat sink, vents, and the like), which are coupled to one another by way of a bus 312 and chipset 904. The examples are not limiting.

Graphical user interfaces for platform 1200 may be generated for at least one of the various embodiments. In some embodiments, user interfaces may be generated using web pages, mobile applications, emails, PDF documents, text messages, or the like. In at least one of the various embodiments, vendor platform, user device, camera, and wearable computer or the like, may include processes and/or API's for generating user interfaces.

Figure 13:
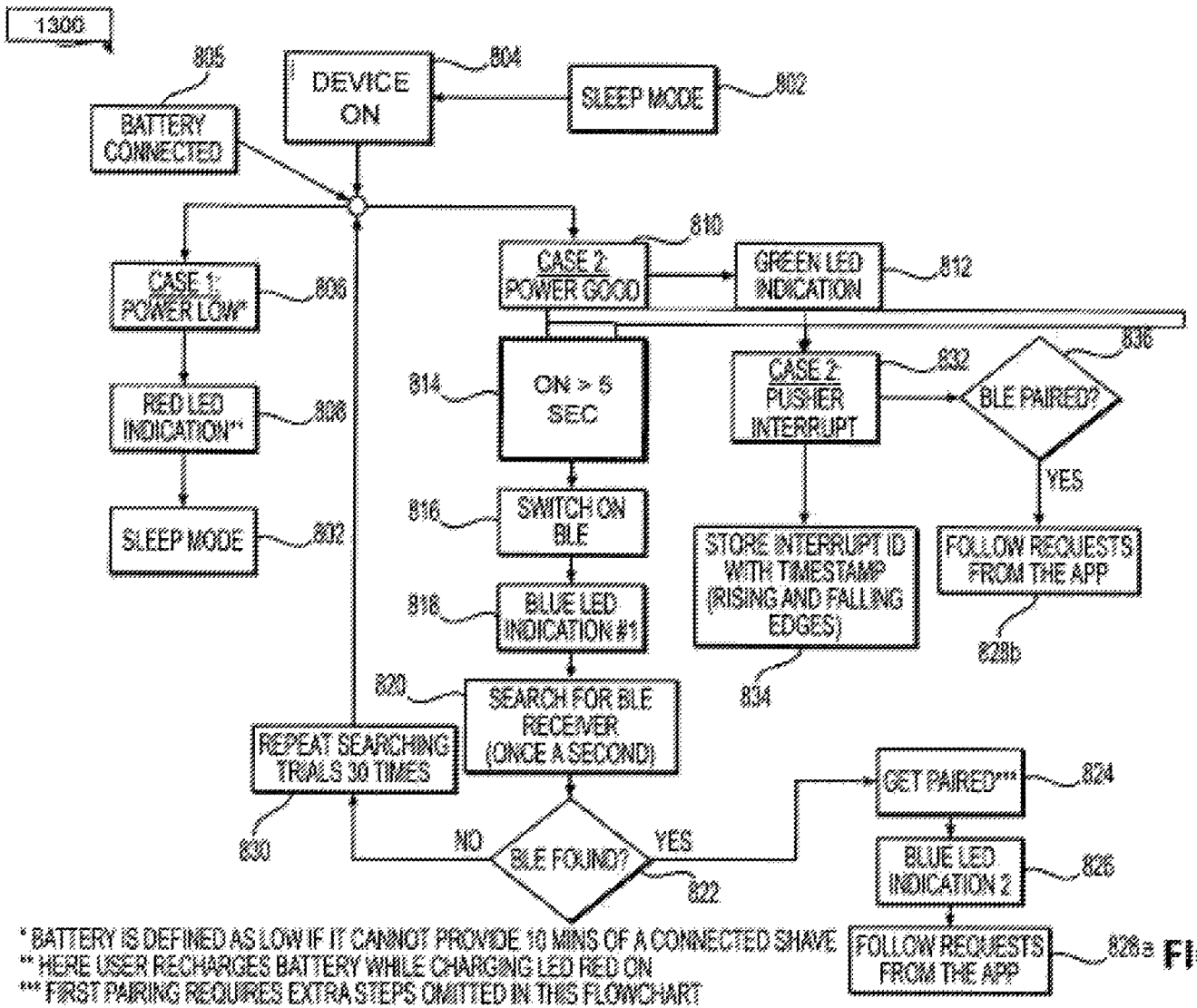
FIG. 13 is a flowchart of an exemplary method of the present disclosure.

A method 1300 is shown in FIG. 13, which illustrates various firmware protocols configured to be run by processor 16 within razor accessory 10. While FIG. 13 is described with respect to firmware protocols a razor accessory, similar protocols may be arranged for an application 111 running on a wearable computer device 110. Method 1300 may begin at block 802, when razor accessory 10 is in a "sleep mode," configured to conserve power. Method 1300 may proceed to block 804, where processor 16 may determine if the razor accessory 10 has been activated for use, for example, whether an input device has been depressed for greater than a first threshold period of time, e.g., two seconds, or if the camera is turned on. If processor 16 determines that the device is on, at block 805 a connection to battery 13 or a power level of battery 13 may be determined. If battery 13 is determined to have a relatively low power level (block 806), or to be depowered altogether, at block 808 a RED LED, or other low-battery indication, is activated, and the processor 16 may enter the sleep mode at block 802. In some examples, battery 13 may be defined as having a low power level if processor 16 determines that battery 13 cannot provide, for example, at least 10 minutes of connectivity user device 40 via wireless transceiver 17.

If, however, at block 805, processor 16 determines that battery 13 has a sufficient power level to proceed with, e.g., a shaving session (block 810), at block 812 a GREEN LED, or other indication indicating a sufficient battery level, is activated.

Once processor 16 has determined that battery 13 has sufficient power to proceed with a shaving session (block 812), method 1300 may proceed in any one of a number of exemplary potential paths, such as the examples identified as Case 1 and Case 2 in FIG. 13.

Case 1 (block 814) may result when device is turned on (e.g., a relatively long sensor input or image movement) for an extended input, e.g., greater than five seconds. A relatively long input may be caused, for example, when a user first begins to shave via a long shave stroke, or from the user activating an input device ("on") for greater than a second threshold period of time that is greater than the first threshold period of time. The second threshold period of time may be five seconds, for example, or may be another suitable time period. Instead of a second threshold period of time, processor 16 may respond to different commands at block 814, such as, for example multiple quick and successive activations of an input device. If processor 16 makes a positive determination at block 814, at block 816 a wireless communication module 17 (e.g., a Bluetooth Low Energy transmitter) may be activated, and to block 818 where a first BLUE LED indication may be activated to indicate that wireless communication module 17 is in a "discoverable"

mode. At a block 820, wireless communication module 17 may search for a compatible receiver, such as, e.g., a Bluetooth Low Energy receiver in a user device 40. The search may be performed at a rate of once per second, for example, or any other suitable rate. If at block 822 a compatible device is found, at block 824 razor accessory 10 and the compatible device are paired to one another. A second BLUE LED indication (e.g., multiple blinking lights) may be activated at block 826 to indicate the successful pairing. Then, at block 828*a*, processor 16 may follow instructions provided via an application run on user device 40. If, however, no compatible device is found at block 822, at block 830, a suitable number of attempts, for example, 30 attempts may be made within a predetermined period of time to find a compatible device. If, after the prescribed number of attempts, no compatible device is found, at block 802 the processor 16 may enter the sleep mode.

Figure 14:
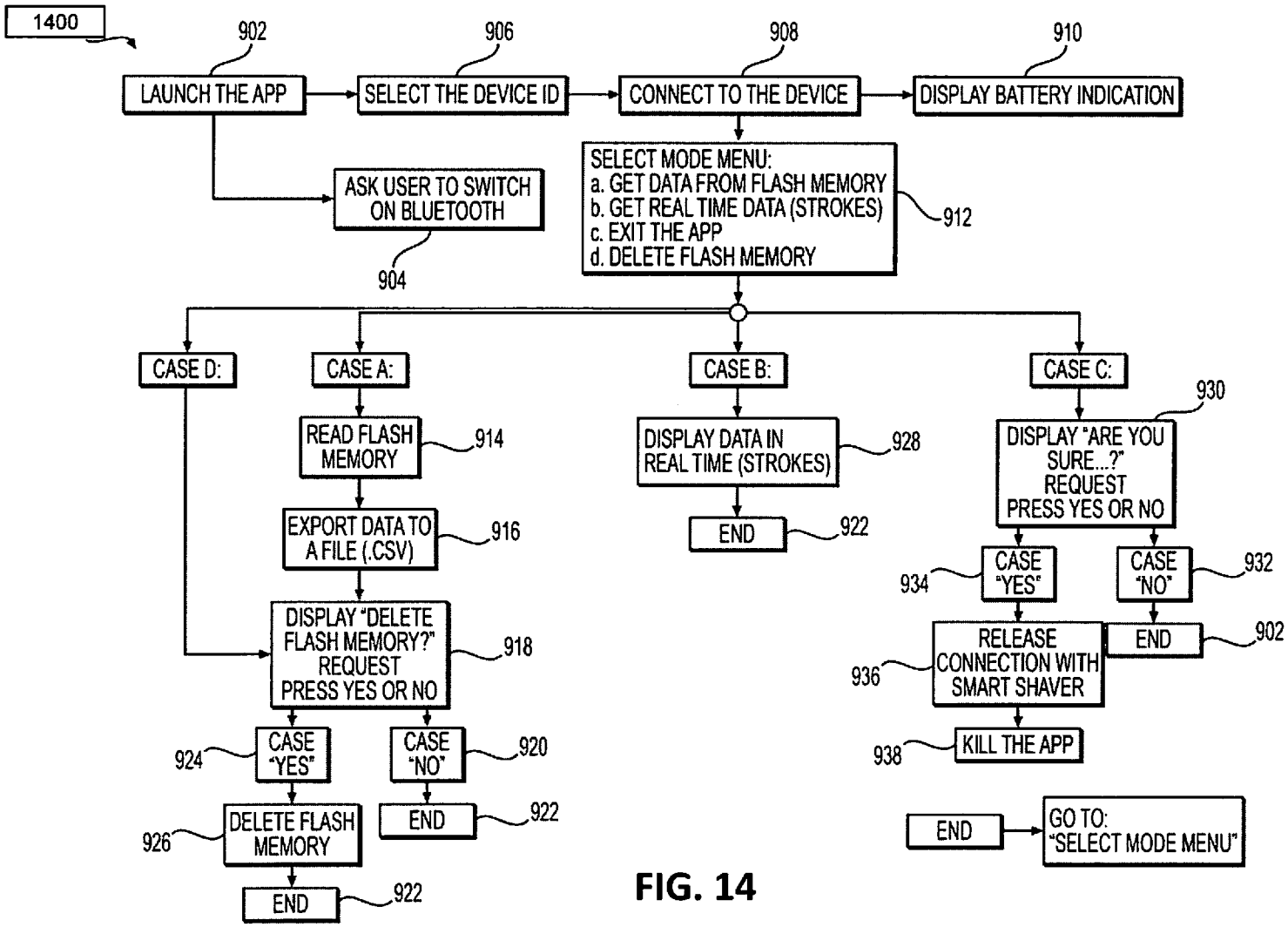
FIG. 14 is a flowchart of an exemplary method of the present disclosure.

A method 1400 is shown in FIG. 14, which illustrates various software protocols configured to be run by processor 1500 for a razor accessory 10 application or wearable computer device 110 application 111. Method 1400 may begin at block 902, where an application installed on, e.g., a smart phone, smart device, or a computer, or other user device 40 may be initiated. At block 904 the application may prompt a user to switch on Bluetooth or another wireless protocol on the device or select the device. At block 908 connection between the device 40 and razor accessory 10 or wearable computer device 110 may be made. From block 908, the method may proceed to block 910, where battery information may be displayed in the application, and/or to block 912, where a menu may be presented to a user. As shown in FIG. 14, an exemplary menu may include (a) "get data from flash memory", (b) "get real time data (strokes)", (c) "exit the app", and/or (d) "delete flash memory." If at block 912, the user selects "get data from flash memory," the method may proceed to block 914, where processor may read memory of razor accessory 10, and may initiate export of the stored data to a file (e.g., a .csv file) at block 916. Method 1400 may proceed to block 918, where the user may be prompted to select whether or not to delete the flash memory. If at block 918, the user selects "No," at block 920, method 1400 may proceed to block 922 and return to menu, block 912. If however, at block 918, the user selects "Yes," at block 924, method 1400 may proceed to block 926 to erase memory 726. Method 900 then may be terminated by proceeding to "End," block 922, from block 926.

If at block 912, the user selects "get real time data (strokes)," method 1400 may proceed to block 928, where real time stroke data, including, e.g., the number and length of shaving strokes taken, may be collected and displayed to the user via a screen of the smartphone, smart device, computer, or other user device 40. Method 1400 then may be terminated by proceeding to "End," block 922, from block 928.

If at block 912, the user selects "exit the app," method 1400 may proceed to block 930 to request confirmation of this action. If the user selects "No," at block 932, method 1400 may be terminated by proceeding to "End," block 922. If the user confirms at block 934 that the application should be exited, the connection, e.g., Bluetooth connection, with razor accessory 10 may be severed at block 936, and the application may be closed at block 938. If at block 912, the user selects "delete flash memory," method 1400 may proceed to block 918 described above. In each instance where method 900 is terminated by proceeding to block 922, the method 1400 may return the user to menu described above in connection with block 912.

As detailed above, embodiments of the present disclosure describe a camera 15 for providing image data and, in examples, one or more sensors associated with a razor accessory 10. Embodiments of the present disclosure also describe an application 111 and one or more sensors associated with a wearable computer device 110. Razor accessory 10 or wearable computer device 110 are configured to obtain data relating to, for example, number of strokes made with razor 1, length of a shaving session, an area of a body shaved, duration of a shave stroke, and/or force applied to a razor and, consequently, the skin shaved by a user. One or more processor(s) 1500 may be configured to analyze (via suitable algorithms) data associated with images or sensors, as well as a time period associated sensor data or image data to determine the length of a shave session. In some embodiments, the information determined from the data obtained from razor accessory 10 or wearable computer device 110 may be displayed to a user via, e.g., a screen on a smartphone, smart device, computer, and/or other user device 40. The data also may be transmitted to a suitable third party, e.g., a manufacturer of shaver or components thereof.

An area of a body shaved by comparing a number of shave strokes and stroke duration to historical data. For example, a shaving session for an underarm may generally comprise 20% of the shave strokes generally associated with a shaving session for a face.

The techniques described herein are exemplary and should not be construed as implying any specific limitation on the present disclosure. It should be understood that various alternatives, combinations and modifications could be devised by those skilled in the art. For example, steps associated with the processes described herein may be performed in any order, unless otherwise specified or dictated by the steps themselves. The present disclosure is intended to embrace all such alternatives, modifications and variances that fall within the scope of the appended claims.

It will be understood that each block of the flowchart illustration, and combinations of blocks in the flowchart illustration, may be implemented by computer program instructions. These program instructions may be provided to a processor to produce a machine, such that the instructions, which execute on the processor, create means for implementing the actions specified in the flowchart block or blocks. The computer program instructions may be executed by a processor to cause a series of operational steps to be performed by the processor to produce a computer-implemented process such that the instructions, which execute on the processor to provide steps for implementing the actions specified in the flowchart block or blocks. The computer program instructions may also cause at least some of the operational steps shown in the blocks of the flowchart to be performed in parallel. Moreover, some of the steps may also be performed across more than one processor, such as might arise in a multi-processor computer system or even a group of multiple computer systems. In addition, one or more blocks or combinations of blocks in the flowchart illustration may also be performed concurrently with other blocks or combinations of blocks, or even in a different sequence than illustrated without departing from the scope or spirit of the invention.

Accordingly, blocks of the flowchart illustration support combinations of means for performing the specified actions, combinations of steps for performing the specified actions and program instruction means for performing the specified actions. It will also be understood that each block of the flowchart illustration, and combinations of blocks in the flowchart illustration, may be implemented by special purpose hardware-based systems, which perform the specified actions or steps, or combinations of special purpose hardware and computer instructions. The foregoing example should not be construed as limiting and/or exhaustive, but rather, an illustrative use case to show an implementation of at least one of the various embodiments.

Some examples of a computer readable storage medium or machine-readable storage medium may include tangible media capable of storing electronic data, e.g., volatile memory or non-volatile memory, removable or non-removable memory, erasable or non-erasable memory, writeable or re-writeable memory, and the like. Some examples of computer-executable instructions may include suitable type of code, e.g., source code, compiled code, interpreted code, executable code, static code, dynamic code, object-oriented code, visual code, and the like. The examples are not limited in this context.

The terms "comprise" or "comprising" are to be interpreted as specifying the presence of the stated features, integers, steps or components, but not precluding the presence of one or more other features, integers, steps or components or groups thereof. The terms "a" and "an" are indefinite articles, and as such, do not preclude embodiments having pluralities of articles. The terms "coupled," "connected" and "linked" are used interchangeably in this disclosure and have substantially the same meaning.

Some embodiments may be described using the expression "one embodiment" or "an embodiment" along with their derivatives. These terms mean that a particular feature, structure, or characteristic described in connection with the embodiment is included in at least one embodiment. The appearances of the phrase "an embodiment" in various places in the specification are not necessarily all referring to the same embodiment.

The invention claimed is:

1. A razor accessory, comprising:

a body portion comprising:

a camera configured to record an image during a shaving process;

a fastener configured to mechanically attach the razor accessory to a razor;

wherein the razor accessory is communicatively connected to a control unit configured to process image data of the image recorded by the camera to determine at least one physical characteristic of at least one of the user's skin surface or the user's body contour, and wherein the razor accessory further includes a notification unit configured to provide a notification based on an assessment of a user's shaving technique by the control unit, wherein the assessment of the user's shaving technique is based on an analysis of the image recorded by the camera.

2. The razor accessory of claim 1, further comprising:

a light source configured to illuminate the at least one of the user's skin surface or the user's body contour when the camera records the image.

3. The razor accessory of claim 1, further including at least two flexible flaps which are configured to wrap around a razor handle and fix the razor accessory, wherein the flaps include a mechanical fastener.

4. The razor accessory of claim 1, wherein the notification unit is configured to generate a visual, haptic and/or sound notification.

5. The razor accessory of claim 1, further including an interface unit configured as an interface for external power connection and/or external data connection.

6. The razor accessory of claim 1, further including a transceiver unit for wireless communication, wherein at least some data transfer protocols for the wireless communication comprises a hypertext transfer protocol (HTTP), a message queuing telemetry transport (MQTT), or a constrained application protocol (CoAP).

7. The razor accessory of claim 1, including one or more activity sensors for detecting an activity of a user of the accessory on the razor, wherein the activity sensors include one or more of an accelerometer, gyroscope, motion sensor, and/or a combination thereof to detect motion.

8. The razor accessory of claim 7, wherein one of more of the activity sensors are operatively connected to a transceiver unit.

9. The razor accessory of claim 7, wherein the one or more activity sensors are configured to generate activity data that is configured to determine whether the user is engaging in one or more activities with the razor accessory.

10. A wearable computer device configured for a shaving system, comprising:

one or more sensors to track a user's shaving motions while shaving, wherein the wearable computer device is communicatively connected to a control unit configured to determine at least one shaving movement characteristic based on the user's shaving motions tracked by the one or more sensors; and a feedback element configured to aid in providing feedback information based on the determined at least one shaving movement characteristic.

11. The razor accessory of claim 1, wherein the notification unit is configured to:

provide a notification to adjust a shave stroke or change direction of movement of the razor, based on an output of the control unit, provide the notification during the shaving process while the razor is being used, and provide the notification based on the image recorded by the camera.

12. The razor accessory of claim 1, wherein the notification unit is configured to provide a notification to adjust a shave stroke or change direction of movement of the razor, based on an output of the control unit;

wherein the notification unit is configured to provide the notification based on the image recorded by the camera; and wherein the notification unit is configured to provide the notification when the image recorded by the camera indicates suboptimal or poor shaving technique.

13. The razor accessory of claim 1, wherein the notification unit is configured to provide a notification during the shaving process, based on the image recorded by the camera, that a skin surface of a user has been adequately shaved.

14. The razor accessory of claim 1, wherein the razor accessory includes the control unit.

15. A shaving system, comprising:

the razor accessory of claim 1, the control unit, and a transceiver configured to transmit information from the razor accessory to the control unit and from the control unit to the razor accessory.

16. A shaving system, comprising:

at least one control unit communicatively connected to a razor accessory and configured to:

process image data of the image recorded by a camera;

determine at least one physical characteristic of at least one of a user's skin surface or the user's body contour; and determine whether a user's shaving technique is sub-optimal or poor based on the determined at least one physical characteristic.

17. The shaving system of claim 16, wherein the at least one control unit is configured to determine, based on the at least one physical characteristic, a suggestion for a razor model, a razor cartridge model, a razor usage, and/or an optimal shaving product.

18. The wearable computer device of claim 10, further comprising the control unit.

19. The razor accessory of claim 1, wherein the control unit is configured to determine whether the user's shaving technique is optimal or suboptimal based on at least one of:

a type of hair the user has, the user's desired level of shave, a type of cream or gel applied, the user's shaving history, a shape of the user's body, a density of hair on the user's body, a use history of blades, a type of razor used, the user's skin type, the user's age, whether the user is taking an efficient or optimal path during a shaving stroke, whether the shaving stroke is greater than or less than a predetermined stroke length, whether a tempo of the stroke is greater than or less than a predetermined tempo, a number of pauses in the shaving stroke, whether a speed of the shaving stroke is above or below a predetermined speed, and/or whether the user is applying a force at an portion of the shaving stroke that is above or below a predetermined force.

20. A method of analyzing shaving information using the wearable computer device of claim 10, comprising:

receiving data sensed by the one or more sensors, receiving the image recorded by the camera, determining feedback information based on the received data and image, the feedback information including at least one of:

a shaving cartridge suited for the at least one determined movement characteristic, a shaving razor suited for the at least one determined movement characteristic, a suggestion for a razor usage, an indication of a suboptimal shaving technique, and/or an indication of an optimal shaving technique; and sending the determined feedback information to the wearable computer device.

* * * * *